US010821456B2

(12) United States Patent
Hennemann et al.

(10) Patent No.: US 10,821,456 B2
(45) Date of Patent: Nov. 3, 2020

(54) DEVICE FOR DISPENSING A PRODUCT WITH IMPROVED TRIGGERING

(71) Applicant: PROMENS SA, Bellignat (FR)

(72) Inventors: Pascal Hennemann, Vaux les Saint Claude (FR); Gwénael Doulin, Sainte Euphemie (FR); Joey Kurtz, Wasselonne (FR)

(73) Assignee: PROMENS SA., Bellignat (FR)

( * ) Notice: Subject to any disclaimer, the term of this patent is extended or adjusted under 35 U.S.C. 154(b) by 0 days.

(21) Appl. No.: 16/492,596

(22) PCT Filed: Mar. 7, 2018

(86) PCT No.: PCT/FR2018/050527
§ 371 (c)(1),
(2) Date: Sep. 9, 2019

(87) PCT Pub. No.: WO2018/162850
PCT Pub. Date: Sep. 13, 2018

(65) Prior Publication Data

US 2020/0047202 A1 Feb. 13, 2020

(30) Foreign Application Priority Data

Mar. 7, 2017 (FR) ..... 17 51827

(51) Int. Cl.
*B05B 11/00* (2006.01)

(52) U.S. Cl.
CPC ..... *B05B 11/304* (2013.01); *B05B 11/0067* (2013.01); *B05B 11/3004* (2013.01);
(Continued)

(58) Field of Classification Search
CPC ..... G01F 15/005; G01F 11/04; G01F 11/082; B05B 11/304; B05B 11/0067; B05B 11/3004; B05B 11/3047; B05B 11/3064
(Continued)

(56) References Cited

U.S. PATENT DOCUMENTS 8,863,993 B2 * 10/2014 Donnette ..... B05B 11/3004 222/321.6
9,079,206 B2 * 7/2015 Doulin ..... B05B 11/3061
(Continued)

FOREIGN PATENT DOCUMENTS

EP 0479451 A2 4/1992
EP 0649684 A2 4/1995
(Continued)

OTHER PUBLICATIONS

International Search Report for corresponding application PCT/FR2018/050527 filed Mar. 7, 2018; dated Jun. 7, 2018.

*Primary Examiner* — Patrick M. Buechner
*Assistant Examiner* — Michael J. Melaragno
(74) *Attorney, Agent, or Firm* — Cantor Colburn LLP

(57) ABSTRACT

The invention relates to a device (1) for dispensing a product (L), comprising: an element for connection to a container (R) containing the product; a piston (3) that is stationary in relation to the connection element; a cylinder body that moves around the piston, thereby defining a dosing chamber (100), the piston comprising a dosing inlet (35) for said chamber and the apex (64) of the dosing chamber comprising an outlet of the dosing chamber; and an inflow non-return valve (5) with a membrane for opening or closing the dosing inlet, the piston being in two parts, one of which forms a sealing joint with the cylinder body, the piston and
(Continued)

the inflow non-return valve forming separate parts and being arranged such that the membrane is tightly clamped to the top of the piston.

19 Claims, 13 Drawing Sheets

(52) U.S. Cl.
CPC ..... *B05B 11/3047* (2013.01); *B05B 11/3064* (2013.01); *B05B 11/3061* (2013.01); *B05B 11/3074* (2013.01)

(58) Field of Classification Search
USPC ..... 222/387
See application file for complete search history.

(56) References Cited

U.S. PATENT DOCUMENTS 9,151,281 B2 * 10/2015 Donnette ..... B05B 11/0075
10,357,790 B1 * 7/2019 Hennemann ..... B05B 11/00412
2003/0015552 A1 * 1/2003 Bistolfi ..... B05B 7/0037 222/145.6
2010/0102090 A1 * 4/2010 Hummel ..... B05B 11/0029 222/153.13
2012/0024904 A1 * 2/2012 Doulin ..... B05B 11/3035 222/207
2013/0037572 A1 * 2/2013 Yapaola ..... B05B 11/3015 222/175
2013/0164156 A1 * 6/2013 Donnette ..... B05B 11/0075 417/395
2013/0175303 A1 * 7/2013 Donnette ..... B05B 11/3042 222/321.6
2014/0346195 A1 * 11/2014 Doulin ..... B05B 11/3035 222/207
2015/0014990 A1 * 1/2015 Bodet ..... F16L 23/04 285/406
2015/0344214 A1 * 12/2015 Yamaguchi ..... B65D 83/38 222/95
2016/0144388 A1 * 5/2016 Hennemann ..... B05B 15/30 222/173

FOREIGN PATENT DOCUMENTS

FR 2848618 A1 6/2004
FR 3013614 A1 5/2015
WO 2013001193 A1 1/2013

* cited by examiner

DEVICE FOR DISPENSING A PRODUCT WITH IMPROVED TRIGGERING

TECHNICAL FIELD

The present disclosure relates to a device for dispensing a liquid or pasty product to be dispensed, in particular a creme, an ointment or a paste, in particular for cosmetic use.

More particularly, the present disclosure relates to a device for dispensing intended to be mounted on an opening of a container that contains the product to be dispensed, in such a way that the product exits through a dispensing orifice of the device for dispensing by passing from the opening of the container and through the dispensing orifice.

More particularly, this device for dispensing forms a pump with a dosing chamber that allows for the dispensing of a given quantity, corresponding to the volume of this dosing chamber.

BACKGROUND

It is known from prior art dispensing devices that are mounted on the neck of a container containing a liquid or a creme.

These devices include parts that form a pump, in particular a cylinder body that is stationary with respect to the container and a piston descending in this cylinder body. A central duct extends longitudinally inside the piston and the rod which drives it in displacement. An end of this duct is connected to the dosing chamber on the piston; the other end is connected at the top of the rod to an additional duct leading to a dispensing orifice of the product.

When the pump is already triggered, i.e. the dosing chamber and all of the communication spaces between this chamber and the dispensing orifice are filled with the product to be dispensed, the actuating of the piston by a push-button therefore makes it possible to deliver the product present in the dosing chamber formed between the bottom of the cylinder body and the bottom of the piston, through the central duct, to the dispensing orifice. When the piston moves in the opposite direction, a depression is created, driving the aspiration of the product in the dosing chamber. The presence of non-return valves on the inlet of the dosing chamber and on the outlet thereof, allows the product to be correctly delivered in the direction of the dispensing orifice when the piston descends and aspirated when it rises.

Among these devices, dispensing devices are known with three non-return valves: a first one at the inlet of the dosing chamber, a second at the outlet of the dosing chamber and a third, referred to as dispensing valve, on the dispensing orifice. During the delivery, the force exerted by the product drives the opening of the dispensing valve and allows the product to be dispensed. This dispensing valve has for purpose to close the dispensing orifice and to protect the product, in particular the creme, from bacterial contaminations or from the drying out of the latter between two uses.

This dispensing valve however has a certain resistance to opening in order to prevent a weak pressure from opening it, and therefore to prevent unintentional openings.

There are also dispensing devices, such as the one of document WO2013001193 A1, comprising only two valves: a low valve at the inlet of the dosing chamber and a dispensing valve on the dispensing orifice. They therefore do not include an intermediate valve on the dosing outlet.

In these different devices, at the beginning of use, the communication spaces are filled with air. It is necessary to purge them of this air in order to fill them with liquid. One or several back-and-forth movements must then be carried out with the piston. The piston removes the air from the dosing chamber towards these communication spaces, inside of which the air is therefore compressed, until the pressure is sufficient to open the dispensing valve. The air then exits from the device for dispensing, which closes once the air is removed and the pressure becomes insufficient to maintain the dispensing valve open. Then, the piston rises aspirating a certain quantity of product in the container by the low valve. The operation is repeated if necessary until the air is entirely purged. These purging operations correspond to triggering.

These devices operate well when the quantities to be dispensed are relatively substantial. Indeed in such a case, the volume of the dosing chamber is sufficient to generate a sufficient pressure in the communication spaces to allow for the opening of the dispensing valve. However below a certain dosing volume, the triggering can be tedious, and even be subjected to malfunctions.

Thus, in the case of devices that use only two valves, such as mentioned hereinabove, there is a limit dosing volume below which the pressure is insufficient to carry out this triggering, as the pressure is insufficient to open the dispensing valve.

Moreover in a case where it is close to this limit, just enough to be able to open the valve and carry out the triggering, problems of unpriming can however occur, if bubbles of rather substantial size are present in the liquid and rise in these communication spaces.

In the case of devices that use three valves mentioned hereinabove, there is no unpriming, however with a dosing chamber of low volume, this must be pumped several times before the pressure between the top valve and the dispensing valve is sufficient so that the latter opens. The triggering will be tedious. At worst, the user may believe that the device for dispensing is defective and discard this device.

A solution can be to decrease the resistance of the dispensing valve but this increases the risks of accidental dispensing and/or of putting the outside air and into contact with the liquid contained in the communication spaces, which can be inconvenient for certain products, for example when the latter oxidize easily in the air.

Moreover, the applicant noticed that certain triggering problems came directly from the problem of the tightness on the non-return valve, in particular in the case of an inflow non-return valve is the form of a ball in certain devices of prior art. This non-return valve in the form of a ball is displaced according to gravity and the position of the dispensing system and can lose its tightness.

Also, document FR2848618 discloses devices with two valves, of which the manual pump is inverted, namely that it is the piston that is stationary and the cylinder body movable. The non-return valve forms therein a single piece with the piston.

This valve forms indeed a part of the piston. This part forms a cap, of which the annular skirt provides the lateral tightness of the piston. The bottom of the cap comprises a central opening that cooperates with a nipple formed at the apex of the rigid base of the piston, in such a way as to open or close the inlet in the dosing chamber. However the tightness of this non-return valve can be improved.

BRIEF SUMMARY

The disclosure seeks to improve the triggering of a device for dispensing, in particular when its dosing chamber has a small volume, for example between 0.15 and 0.4 milliliters (ml).

To this effect, the disclosure provides a device for dispensing a liquid or pasty product to be dispensed comprising:

- a connection member intended to be installed at the open end of a container enclosing the product to be dispensed,
- a piston fixedly arranged with respect to the connection member,
- a cylinder body in which the piston is arranged in such a way as to define a dosing chamber between the piston and the cylinder body, the piston comprising at least one upstream opening forming an inlet of the dosing chamber, referred to as dosing inlet, and the dosing chamber comprising an outlet, referred to as dosing outlet, the cylinder body being slidable along the piston between a deployed position and a retracted position,
- an inflow non-return valve mounted on the piston and comprising an inflow membrane having a concave shape, the piston comprising a first part and a second part forming a sealing member fitted or over-molded around at least one portion of the first part, with this sealing member reinforcing the seal between the piston and the side wall or walls of the cylinder body, the piston and the inflow non-return valve forming separate parts and being arranged in such a way:

- that, when the cylinder body is immobile or is displaced towards the retracted position, the inflow membrane is tightly clamped to the top of said joint and closes the dosing inlet, and
- that the concave shape of the inflow membrane is elastically deformed and opens the dosing inlet when it is subjected to a negative pressure generated in the dosing chamber during the displacement of the cylinder body towards its deployed position.

Thus, by carrying out a fixed piston and a movable cylinder body, the latter descends on the piston, removing the air from the dosing chamber directly from the top of the dosing chamber, which makes it possible to reduce the communication spaces between the dosing chamber and the dispensing valve.

The effect of this inverted pump mentioned in the paragraph hereinabove is increased by the particular realization of the piston and of the valve according to the disclosure mentioned hereinabove. This particular realization of the piston and of the valve, of which the membrane is arranged in such a way as to allow a fluid to pass via the inlet of the dosing chamber only towards the inside of the dosing chamber, allows for a reinforcing of the tightness on the inlet of the dosing chamber, in particular when the cylinder body retracts on the piston.

This tightness, and therefore this increase in pressure, is reinforced by a synergy between the following characteristics:

- the tight clamping,
- the realization of the piston in two parts, of which one with a lateral tightness function, whereon the tight clamping is carried out, and
- a valve separate from the piston, in particular from the second part thereof.

With regards to the tight clamping, with the device for dispensing according to the disclosure, the inflow non-return valve is fixed on the piston with a pre-stressed seal between the piston and the non-return valve, which makes it possible to retain a constant tightness clamping at rest, namely when the cylinder body is not moving, or during the displacement of the cylinder body towards the retracted position, or end-of-travel position, regardless of the position of the device for dispensing during this displacement towards the retracted position.

With regards to the carrying out of the piston in two parts, the non-return valve and the second part of the piston are both designed in such a way as to provide tightness. Consequently, the tight clamping between this sealing member and this valve is all the more so effective, what is more with the pre-stress mentioned in the preceding paragraph.

In particular, this valve and this sealing member can each be formed from a flexible material, compared to the first part of the piston made from a rigid material. The material of the valve and the material of the sealing member can be identical.

Thus this synergy makes it possible to reduce the risks of triggering problems occurring. Thus the increase in pressure in the system during triggering is improved, thus making it possible to compensate the presence of dead volumes and thus use dosing chambers with lower volume.

The device for dispensing can form a manual pump.

Note that in the device for dispensing the dosing chamber is defined between the top of the piston and the apex of the dosing chamber. In particular, the inflow non-return valve is mounted on the piston facing the apex of the dosing chamber.

Note that the deployed position corresponds to a position in which the apex of the dosing chamber is at a distance from the inflow non-return valve and from the piston.

Also note that the retracted position, or end-of-travel position, corresponds to a position in which the apex of the dosing chamber is closer to the inflow non-return valve than in the deployed position, in particular the apex of the dosing chamber being against the inflow non-return valve.

The application device according to the disclosure can optionally have one or more of the following characteristics:

- the concave shape of the inflow membrane is deformed in such a way as to generate a return force of the membrane against the top of the piston, in such a way as to maintain a tightly clamped stress;
- the dosing inlet is arranged in communication with a passage orifice of the connection member intended to receive the liquid coming from the container;
- the device for dispensing comprises a dispensing orifice in communication, in particular via communication spaces, with the dosing outlet;
- the first part of the piston comprises a central duct in communication on one side with the liquid and on the other side with the dosing inlet,
- the inflow non-return valve is assembled in a sealed manner on the piston with a dimensional tightening pre-stress given by the concave shape of the inflow membrane which results by a fluidic seal, to air and to liquids; the term dimensional tightening pre-stress means a tightening carried out in such a way that once the valve installed on the piston, it undergoes a deformation, here at the level of its concave shape, with respect to the shape of this concave shape when it is not subjected to any stress; this concave shape is thus pre-stressed;
- the inflow non-return valve loses its tightness with the piston and the membrane is deformed elastically from a difference in negative pressure between the inside of the dosing chamber and the outside of the device for dispensing less than −20 mbar; thus, this tightness is broken by an elastic deformation of the membrane, from a very low difference in pressure, which makes it possible to allow the fluids into the dosing chamber;

the inflow membrane has the shape of a cup of which the edge, hereinafter inflow cup edge, delimits the periphery of the concave shape, with the concave shape facing the dosing inlet and the inflow cup edge being arranged around the dosing inlet, the inflow cup edge bearing under elastic stress against the top of the sealing member during said tight clamping, namely when the cylinder body is immobile or is displaced towards the end-of-travel position, and the inflow cup edge moving away from the top of the piston during a negative pressure in the dosing chamber; the applicant noticed that such a shape made it possible in a simple manner to have good results for the maintaining of the tightness, including during the increase in the pressure in the dosing chamber;

the sealing member comprises a central opening delimited by a flared surface and inside of which is arranged the dosing inlet, with this central opening widening from upstream to downstream, the inflow non-return valve being mounted in such a way that, during said tight clamping, the inflow cup edge is bearing above and against this flared surface; the pressing in tight stress is thus reinforced; this flared surface can be conical;

the inflow non-return valve comprises a central portion fixed to the top of the piston, the membrane being arranged around this central portion; this type of valve is well suited to cooperate in a more uniform tight clamping on the sealing member;

the upper part of the first part of the piston comprises clipping lugs, between which is clipped the central portion, with the dosing inlet or inlets being arranged between these clipping lugs and the clipped part of the central portion; this allows for a realization and a simple mounting of the valve as well as the dosing inlet or inlets;

the clipping lugs comprise a convex upper portion of which the convexity is arranged facing the concavity of the concave shape; this makes it possible to prevent a risk of the membrane turning over in clamping and reinforces the latter;

the piston is mounted in a tubular portion of the connection member; this facilitates the realization of the piston in two parts, in particular when the sealing member formed by the second part is over-molded on the first;

the stroke of the piston is less than the length of the sealing member; this allows the sealing member to not exceed the bottom of the portion of the cylinder body in contact with the product to be dosed; this decreases the risks of product leaking outside the dosing chamber;

the apex of the dosing chamber forms a top wall;

the dosing outlet is formed inside the top wall;

in retracted position, at least one portion of the surface of the top wall is entirely covered, with this portion comprising the dosing outlet, with this covering being carried out either by a surface downstream of the inflow non-return valve, or by a surface downstream of the inflow non-return valve and one or several portions of the piston; thus the air is practically completely, even completely, removed from the dosing chamber, during the displacement of the cylinder body towards the retracted position thereof; according to certain alternatives, this covering is carried out over the entire top wall;

the inflow non-return valve or the inflow non-return valve and the piston are arranged in such a way as to follow the shape of the surface of the top wall, in the retracted position; this makes it possible to perfectly cover the top wall and to remove all the air inside the dosing chamber;

the inflow non-return valve or the inflow non-return valve and the piston have faces facing the top wall, with these faces being of a shape that is complementary with the shape of at least the portion of the surface of the top wall which comprises the dosing outlet; this is an embodiment that allows for the covering of at least the portion of the top wall in which this outlet is located, and therefore to remove more air from the dosing chamber, during triggering; according to certain alternatives, the shape is complementary with all of the top wall, thus making it possible to remove the air entirely;

the top wall comprises an annular groove arranged facing the inflow non-return valve, in such a way that at the end-of-travel position the concave shape of the inflow membrane is housed in the annular groove; there is thus a shape adapted to the inflow membrane;

the dosing outlet is arranged in the annular groove; the air is thus removed more effectively during triggering, with the membrane pushing the air to a portion that it hugs;

the inflow non-return valve covers only one central sector of the piston, the piston having a peripheral sector arranged around the central sector and facing the top wall, with the latter having a peripheral zone arranged around the annular groove and facing the peripheral sector, with the peripheral zone coming into contact with the peripheral sector in the end-of-travel position; this makes it possible to carry out the friction against the side wall or walls of the dosing chamber only with the piston; the peripheral sector can be formed by a lip;

the device for dispensing comprises an outflow non-return valve arranged between the dosing outlet and the dispensing orifice, in such a way as to clear the passage between the dosing outlet and the dispensing orifice under the exercise of an increase in pressure on this outflow non-return valve; this makes it possible to provide a closing of the device for dispensing when the cylinder body starts back from its end-of-travel position to its deployed position;

the device for dispensing comprises only two valves: the inflow non-return valve and the outflow non-return valve; this is a device that is simple to realize;

the outflow non-return valve is mounted on the dosing outlet, on the cylinder body and outside the latter; thus the outflow non-return valve directly closes the dosing chamber; the dispensing orifice can be arranged immediately after or a little further on by being connected by ducts forming additional communication spaces; this is a simpler mode that can be used for a product that has little risks of contamination, for example, when the liquid itself comprises preservatives and/or antibacterial agents;

according to the preceding paragraph, the outflow non-return valve comprises an outflow membrane having a concave shape able to be deformed elastically in such a way that:

when the outflow membrane is subjected to a negative pressure generated in the dosing chamber during the displacement of the cylinder body towards its deployed position, the outflow membrane closes the dosing outlet by being tightly clamped to the top of the cylinder body, with the concave shape of the outflow membrane being deformed in such a way as to generate a return force of this membrane against the top of the cylinder body, in such a way as to maintain a tightly clamped stress, and when the cylinder body is immobile or is displaced to the end-of-travel position, the concave shape of the outflow membrane is deformed elastically in such a way as to allow the fluid to pass;

the outflow non-return valve is thus fixed on the cylinder body with a pre-stressed seal, which makes it possible to constantly maintain a tight seal during the displacement of the cylinder body to the deployed position, regardless of the position of the device for dispensing during this displacement, and thus reduce the risks of triggering problems occurring, by a new air inlet in the dosing chamber; thus the increase in pressure in the system during triggering is improved;

according to one or the other of the preceding paragraphs, the outflow non-return valve loses its tightness with the apex of the cylinder body and the outflow membrane is elastically deformed from a difference in pressure between the inside of the dosing chamber and the outside of the device for dispensing greater than 20 mbar; the risks of untimely opening of the device for dispensing are thus reduced;

the inflow non-return valve and/or the outflow non-return valve are molded in a flexible material with a Shore A hardness between 30 and 90, in particular a thermoplastic elastomer (also referred to as TPE); this makes it possible to generate a return force to maintain good tightness in the absence of a voluntary action on the cylinder body, without however requiring great effort by the user who wants to trigger or dispense the product;

alternatively or in combination with the preceding paragraph, the membrane of the inflow non-return valve and/or the outflow non-return valve has a thickness between 0.15 and 0.3 millimeters (mm); the combination of this paragraph and of the preceding one makes it possible to optimally obtain a flexibility of the elastic membrane that allows for good closing tightness and a deformation with a low difference in pressure in order to allow the fluids to pass, thanks to this association of a very thin thickness of this membrane with very flexible materials, in particular of the TPE type;

the inflow non-return valve and/or the outflow non-return valve comprising a central portion, the membrane of the corresponding non-return valve or the membranes of these non-return valves being arranged around this central portion, with this or these membranes globally extending transversally in the direction of sliding of the cylinder body along the piston; the inflow membrane and/or, according to the case, the outflow membrane are thus circumscribed in a transversal circle, respectively favoring the covering of the dosing inlet and/or of the dosing outlet; in the case where the apex forms a top wall, it is also possible to improve the covering of the top wall for the most part; in particular the top wall is mostly covered by the inflow membrane;

the central portion of the inflow non-return valve is fixed by clipping inside the piston; this allows for a good maintaining of the non-return valve, while still easily and homogeneously conferring the tightening pre-stress of the inflow membrane on the top of the piston; a fluidic tightness is thus created constantly; indeed, the domed shape of the membrane of the inflow non-return valve provides the spring function of the flexible membrane and makes it possible to maintain a constant clamping stress on the piston;

the central portion of the outflow non-return valve is fixed by clipping inside the apex of the cylinder body, the outflow membrane being arranged outside the latter; this allows for a good maintaining of the non-return valve, while still easily and homogeneously conferring the clamping pre-stress of the outflow membrane on the top of the cylinder body; a fluidic tightness is thus created constantly, the domed shape of the membrane of the inflow non-return valve providing the spring function of the flexible membrane and making it possible to maintain a constant clamping stress on the cylinder body;

the inflow membrane comprises an upper flank facing the top wall and a lower flank facing the piston, with these flanks being separated by an edge, in particular circular, and conferring upon the inflow membrane its concave shape, with the upper flank being convex and the lower flank concave, with the concave shape of the inflow membrane thus having the shape of an annular gutter around the central portion; this allows for an easier deformation of the inflow membrane, when the cylinder body is displaced towards the deployed position thereof and because of this generates a depression inside the dosing chamber and therefore on the upper surface of the inflow membrane, with this depression making it possible to deform this flexible membrane, break the seal of the non-return valve and thus allow the fluid contained in the reservoir on which is mounted the device for dispensing to enter into the dosing chamber;

the outflow valve can have one, several or all of the shape characteristics of the inflow valve;

instead of being mounted on the dosing outlet, the outflow non-return valve can be arranged in such a way as to close or open the dispensing orifice; here a closing of all of the communication spaces is provided; this makes it possible to prevent a contact between the liquid and the air in the device for dispensing; this is a mode that makes it possible to be used with a product sensitive to a bacterial contamination, for example when the liquid itself is devoid of preservatives and/or antibacterial agents;

according to the preceding paragraph, the outflow non-return valve consecutively comprises:

an obturator of the dispensing orifice, an elastically deformable tank membrane connected to the obturator, optionally, an auxiliary returning member, in particular suited to the low pressures that solicit the closing of the obturator, and a hermetic tank hermetically closed by the tank membrane, the outflow non-return valve being arranged in such a way that the face of the tank membrane outside the tank is in fluidic communication with a communication space that connects the dispensing orifice and the dosing outlet, in such a way that on the one hand the tank membrane is stressed in deformation by the product during the actuating of the cylinder body towards said retracted position, in such a way as to drive the release of the obturator of the dispensing orifice, and on the other hand the tank membrane is stressed in the opposite direction during a negative pressure in the dosing chamber, thus returning the obturator to a closed position of the dispensing orifice;

thus the tank membrane is able to be solicited in deformation by the product during the actuating of the cylinder body towards its end-of-travel position, in such a way as to drive the releasing of the obturator of the dispensing orifice; this tank makes it possible in particular to prevent untimely openings of the valve, in particular at low pressures, i.e. less than 2 bars, and in particular at pressures less than 0.4 bars;

the auxiliary returning member is arranged axially inside the hermetic tank, as a permanent connection with the tank membrane, and comprises two elastically deformable stages according to the different characteristics, with the first stage maintaining a constant return force of a predetermined value against said membrane, and consequently on the obturator, with the second stage being inserted between the first stage and the bottom of the tank, and maintaining a return force that is greater than that of the first stage, acting only when the tank membrane is solicited;

the first and second stages come from a central core;

the first stage extends radially around the central core by forming a cup of which the outer edge bears against the inner wall of the tank, with this cup being made from an elastic material; there is thus a spring element with an articulation of the core which makes it possible to return the obturator to the dispensing orifice;

the second stage extends axially from the central core, by forming a bell of which the outer edge bears against the bottom of the tank, with this bell being made from an elastic material and being able to be deformed and to exert a return force only when the tank membrane is stressed;

the device for dispensing comprises a dispensing head firmly mounted with the cylinder body and comprising a housing of which the walls comprise the dispensing orifice and an orifice in communication with the dosing chamber, the outflow non-return valve being arranged inside the housing, in such a way as to define an upper volume hermetically closed on one side by the tank membrane, with this upper volume having as an opening the dispensing orifice and an orifice in communication with the dosing chamber;

the device for dispensing comprises an added tube mounted in the passage orifice of the connection member intended to communicate with the opening of the container, in such a way that the lower end of the tube forms the inlet of the product in the device for dispensing;

the tube has an inner section chosen in such a way that when the cylinder body changes towards its deployed position, the depression in the dosing chamber is greater than or equal to 8 mbar;

the tube has an inner section with a diameter that is at least 20% less than that of the passage orifice;

the tube is extended below the passage opening;

the device for dispensing comprises a reducing ring which is arranged inside the upper volume between and at a distance from the tank membrane and the dispensing orifice and against portions of the inner wall of the housing surrounding the obturator, the reducer having a reduced passage inside of which the obturator is mounted slidingly at a distance from the walls of this reduced passage, the tank membrane having a diameter greater than that of the reduced passage; thus the dead volume in the dispensing head is limited while extending the surface of the membrane over which a fluid pressure can be exerted;

in the device:

the connection member forms a container that houses the piston and the cylinder body, this container has a bottom intended to close the open end of the container, this bottom being passed through by a passage orifice of the product, the connection member comprises a tubular portion extending longitudinally between a first end communicating with this passage orifice and a second end whereon the piston is mounted, with the dosing inlet being in communication with the tubular portion;

this is an embodiment of a mounting of the piston on the base; this easily allows the cylinder body to descend on the piston;

the connection member comprises a drum that extends, in particular longitudinally, from the bottom of the container and around the tubular portion, the cylinder body, the tubular portion and the drum being arranged in such a way that the side wall or walls of the cylinder body slide between the tubular portion and the drum; the guiding in sliding is thus improved;

the side wall or walls of the cylinder body extend between the top wall and an open end, with the latter having a peripheral protrusion protruding on the outer surface of this open end, with the diameter of the cylinder body between this bulge and the top wall being adjusted to the inner diameter of the drum, in such a way that at the approach of the deployed position a radial pressure is generated between the bulge and the top of the inner face of the drum; this makes it possible to create a tightness at the end of travel on the outside of the end of the side wall or walls;

the device for dispensing comprises a spiral spring arranged longitudinally and around the drum, with the spring bearing on one side against the bottom of the container and on the other side against a set of stops fixedly integral with respect to the cylinder body; this makes it possible to maintain the spring and prevent the risks of the latter from buckling;

the spring and the drum are arranged in such a way that the drum guides the turns of the spring during the compression thereof or the expansion thereof; this facilitates the actuating of the cylinder body and its return to the deployed position;

the piston comprises an upper peripheral lip in contact with the side wall or walls of the cylinder body; this makes it possible to improve the tightness of the dosing chamber;

the piston comprises a lower peripheral lip in contact with the side wall or walls of the cylinder body; this makes it possible to block liquid that could have passed between the top of the piston and the side wall or walls;

the piston comprises two parts: a first part comprising a central duct in communication on one side with the liquid and on the other side with the dosing inlet, and a second part forming a sealing member fitted or over-molded around at least one portion of the first part, with this sealing member reinforcing the seal between the piston and the side wall or walls of the cylinder body;

the dispensing orifice is arranged in a push-button comprising a communication between the dispensing orifice and the dosing outlet, the push-button being fixedly mounted on the cylinder body, in particular telescopically in the connection member.

Another object of the disclosure is an assembly for conditioning a liquid or pasty product to be dispensed, said assembly comprising:

- a container intended for enclosing the product to be dispensed, and
- a device for dispensing according to the disclosure installed at the open end of the container, in such a way that a passage orifice of the connection member communicates with the inside of the container.

This assembly for conditioning is thus ready to be filled or filled and ready to be used.

In this application, the terms "top" and "bottom", "upper" and "lower" are applied according to the orientation of the various elements such as they are shown in FIGS. 2 to 7 and 14 to 18. The terms "upstream" and "downstream" are applied according to the direction of circulation of the product during the dispensing thereof.

BRIEF DESCRIPTION OF THE FIGURES

Other characteristics and advantages of the disclosure shall appear when reading the following detailed description of non-limited examples, for the comprehension of which reference will be made to the accompanying drawings, among which.

DETAILED DESCRIPTION

Figure 1:
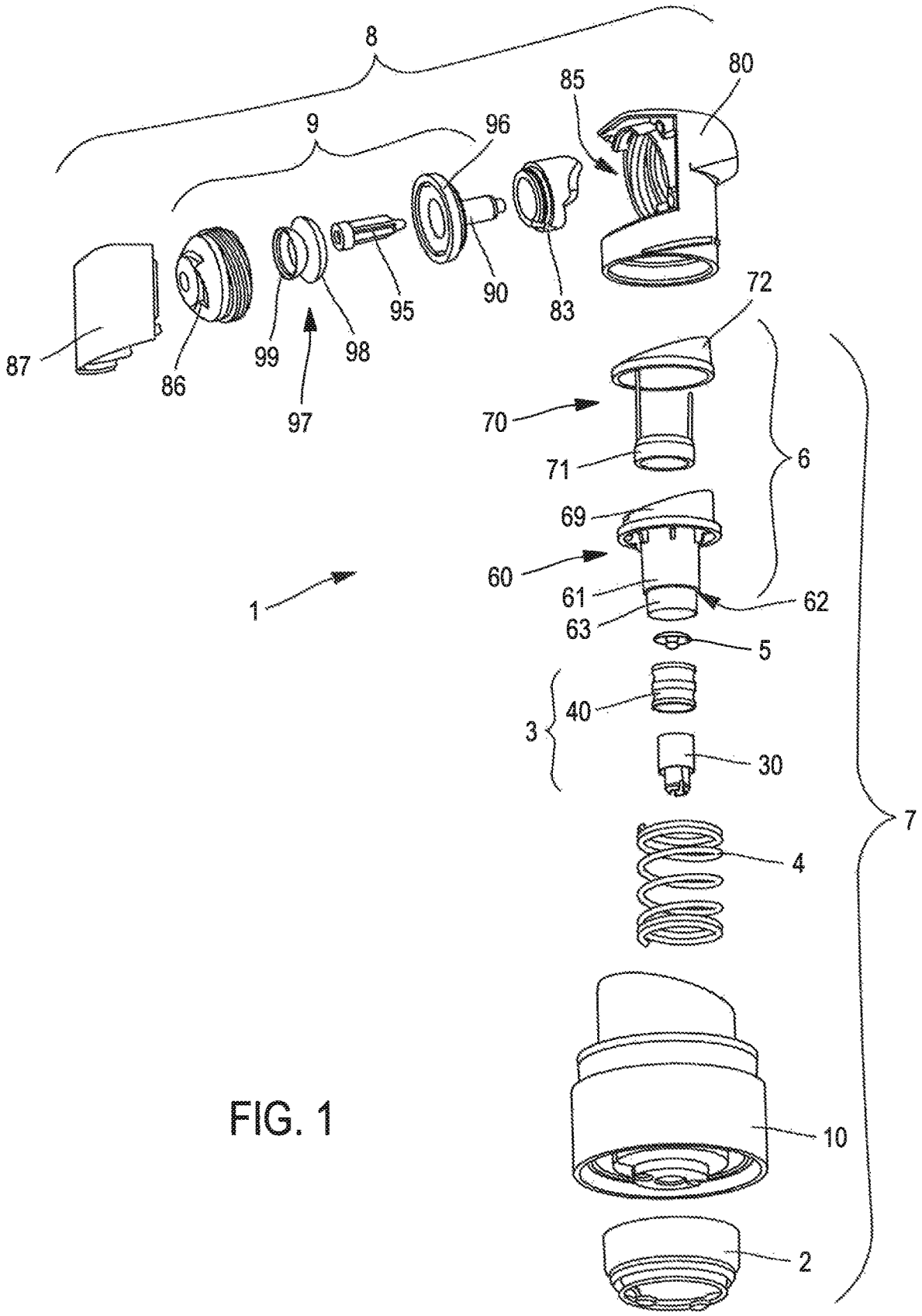
FIG. 1 is an exploded view of an example of a device for dispensing according to a first embodiment, corresponding to a first exemplary embodiment of the disclosure.

FIG. 1 shows an exploded view of the various parts forming a device for dispensing 1 a product L, a liquid in this example, according to a first alternative of a first exemplary embodiment of the disclosure.

The device for dispensing according to the present disclosure can, as in this example, be a pump 1, comprising two main assemblies:

- a dosing part 7
- a dispensing head 8, fixed at the top of the latter.

The dosing part 7 and the dispensing head 8 together form a pump 1. This pump corresponds to the device for dispensing 1.

Figure 2:
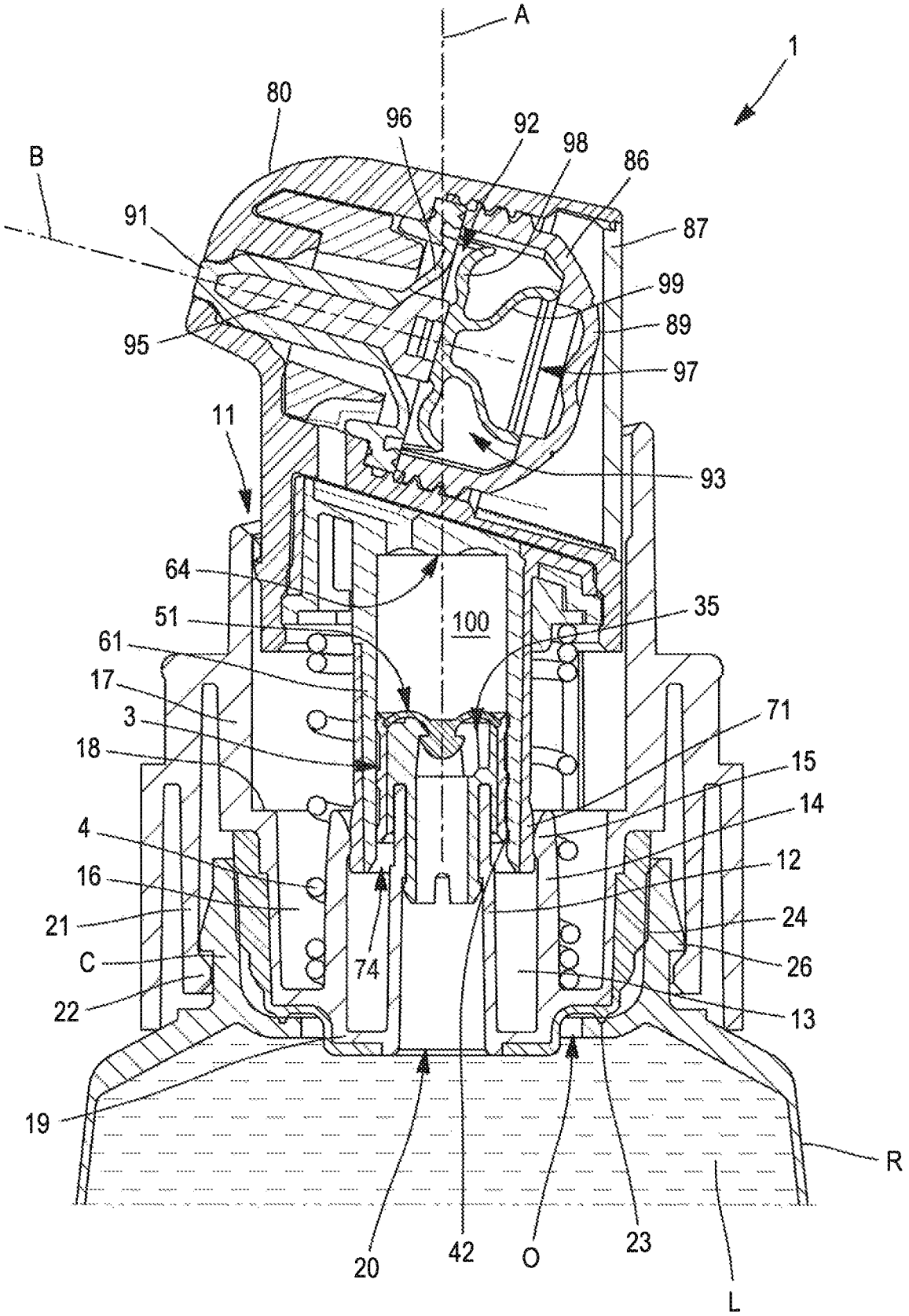
FIGS. 2 to 7 show different phases of the triggering step and of the first dispensing of the liquid by the device for dispensing of FIG. 1.
Figure 3:
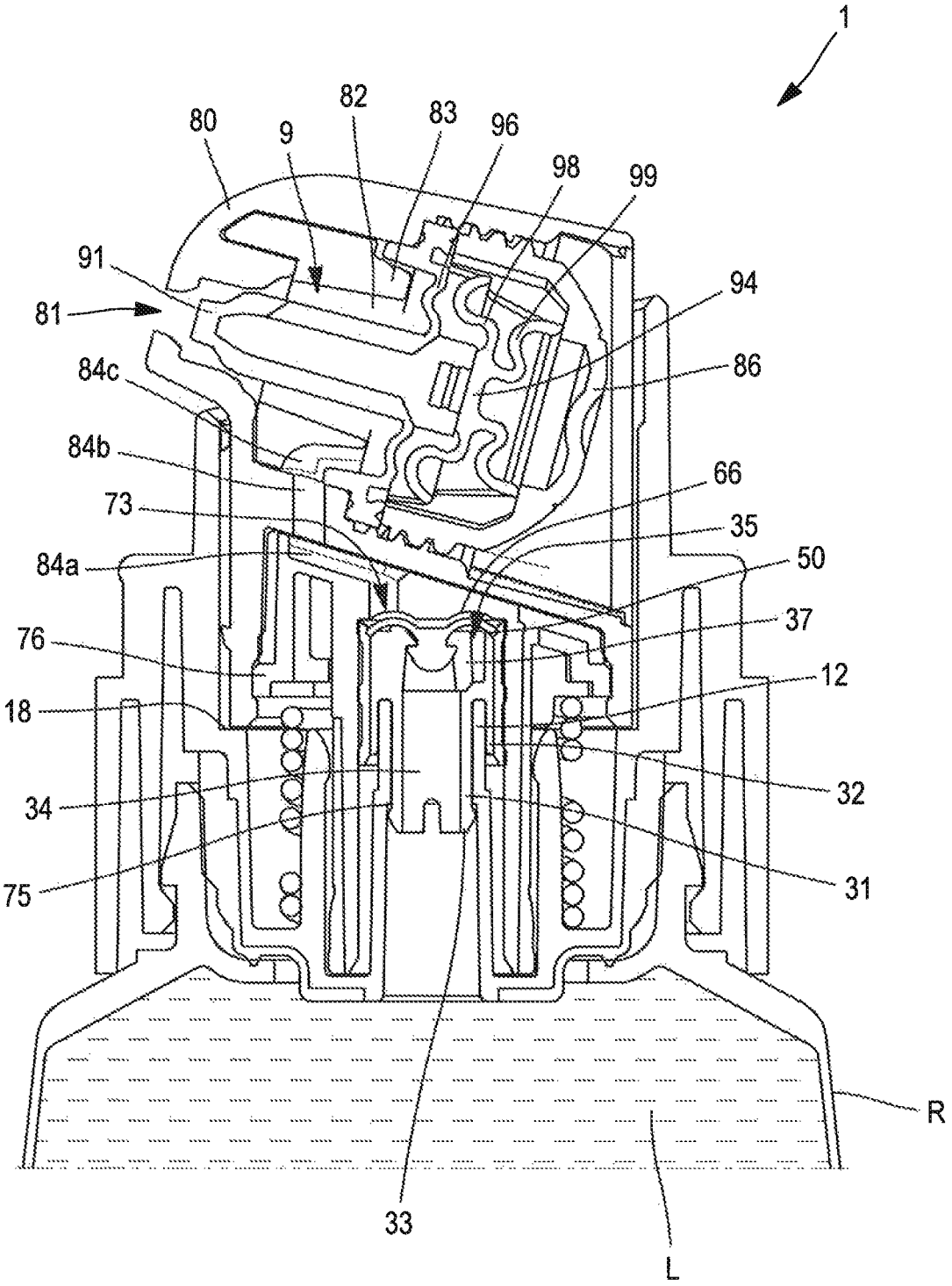

FIGS. 2 and 3 show this pump mounted on a container, here a container R, filled with a liquid L. This can be a cosmetic and/or care product. This pump 1 and this container R thus form an assembly for conditioning the product.

The dosing part 7 comprises a connection member 10 intended, as can be seen in FIG. 2, to be mounted on the neck C of the container thus joining the pump 1 to this container R.

According to the disclosure, and as in this example, the connection member 10 can have a bottom 19 covered by a neck seal 2, mounted between walls of the open end of the container R, in such a way as to provide the tightness against the connection member 10 and this open end.

The dosing part 7 comprises a cylinder body 6 inside of which a piston 3 is mounted.

According to a principle of the disclosure, the piston 3 is fixedly mounted in the connection member 10, the cylinder body 6 being movable by sliding about this piston 3, along an axis of sliding A. This axis of sliding corresponds here to the longitudinal axis of the device for dispensing 1.

According to the disclosure, and as can be seen in FIG. 1, the various elements of the dosing part 7 can be stacked in one another along the axis of sliding A, in the following order:

- a first part 30 of the piston 3, hereinafter base 30 of the piston, mounted inside the connection member 10.
- a second part 40 of the piston, forming a tubular seal 40 and mounted around the base 30 of the piston,
- an inflow non-return valve 5 mounted at the top of the piston 3, and therefore separate from the latter,
- a base 60 of the cylindrical body with a side wall 61 forming a sliding tube arranged around all of the elements hereinabove,
- a pair of sealing members 70 forming with the base 60 of the cylinder body said cylinder body 6,
- a spiral spring 4 mounted in compression between the base 60 of the cylindrical body and the connection member 10, in particular its bottom 19, with the turns here surrounding the sliding tube 61
- the connection member 10, which forms a container inside of which are housed the various elements listed hereinabove.

According to the disclosure, as in the example shown, these elements 30, 40, 5, 60, 70, 10 can individually be formed from a single piece. The dosing part 7 is therefore rather simple.

According to the disclosure, the dispensing head 8 can comprise a push-button 80 integral with the cylinder body 6, in such a way as to drive the latter downwards, via a manual pressing on top of this push-button 80.

This push-button 80 comprises on one side, at the front, a dispensing orifice (not visible in FIG. 1) through which exits the liquid L during the distribution. The latter is located on the right in FIG. 1. On the other side, at the rear, this push-button 80 can, as here, be open, thus giving access to a housing 85.

Inside this housing, the following elements can be stacked in this order and along an axis of obturation B:

- a reducer 83 with a through-passage along the axis of obturation B,
- a part having a portion forming an obturator 90, and at the rear of this first portion, a second portion forming a tank membrane 96,
- an internal reinforcing part 95 of the obturator 90, here, an auxiliary returning member 97, a tank 86 housing the auxiliary returning member 97.

A cap 87 closes the housing 85 of the push-button 80.

According to the disclosure, as in the example shown, with these elements housed inside the push-button 80, the push-button 80 and the cap 87 can individually be formed from a single piece. The dispensing head 8 is therefore rather simple.

Details on these various elements shall be provided more precisely hereinafter, in particular in reference to FIGS. 2 to 7, which show longitudinal sections of the pump 1 mounted on the container R. For reasons of clarity of the drawings, all of the references are not marked on each one of the figures.

FIG. 2 shows the pump 1 before the commissioning of the latter, i.e. before the triggering phase, which consists in purging the air contained between the communication spaces allowing for the conveying of the liquid L to the dispensing orifice 81.

According to the disclosure, the connection member 10 can comprise a central part arranged lower than the portions of fastening to the neck C, in such a way as to be able to extend below the neck C in order to be in contact with the liquid L.

The bottom 19 thus has in the central part, a passage orifice 20 arranged facing the liquid L. This passage orifice 20 forms the inlet of the liquid L inside the pump 1.

In this example, the mounting of the pump is carried out via clipping of the connection member 10 on the neck C.

The connection member comprises a skirt 21, therefore formed from a double wall.

The lower end of the skirt 21 is open and has on the inner wall thereof clipping lugs 22 protruding inwards and cooperating with clipping lugs 26 of the neck. Thus the connection member 10 is blocked on the neck C.

Here inside and at the base of the neck C, edges protrude radially and form an intermediate opening O.

The neck seal 2 forms a dome covering the underneath and the bottom of the connection member 10, by being arranged around the passage orifice 20.

According to the disclosure, the neck seal 2 can, as here, be over-molded on the connection member 10.

In this example, the dome forming the neck seal 2 has on a lower surface a circular lip 23, bearing against the protruding edges of the intermediate opening O, thus forming a first tightness zone on the open end of the container R.

The dome forming the neck seal 2 has an upper edge with a tight bearing zone 24 against the upper inner wall of the neck C, thus forming a second tightness zone on the open end of the container R.

The dome is arranged in such a way that the neck seal 2 is at a distance from inner walls of the neck C between these two tightness zones. Thus, a dry zone is formed between these two tightness zones, which favors the reduction in the risks of contamination.

Around the passage orifice 20 is arranged a tubular portion 12 which extends from the bottom 19 of the connection member 10 longitudinally and upwards. In this tubular portion is press fitted the piston 3. Around the latter, of this piston 3, is mounted the cylinder body 6.

The base 60 of the cylinder body 6 has an inner space delimited at the top by a top wall 64. The sliding tube 61 extends longitudinally downwards from the top wall 64 and an open end 74. The inner space is delimited at the bottom by an open end 74 and on the sides by the sliding tube 61.

In FIG. 2, the cylinder body 6 is mounted to the maximum, in the deployed position, thus releasing a volume between the top wall 64 and the apex of the piston 3, with this volume forming a dosing chamber 100. The top wall 64 thus forms the apex of this dosing chamber 100.

In FIG. 3, the cylinder body 6 is entirely descended on the piston 3 and is in the end-of-travel position.

According to the disclosure, as in this example, the piston 3 can include a central duct 34 leading directly via passages 37 with openings 35 giving into the dosing chamber 100. These openings form the inlets of liquid L in the dosing chamber 100, hereinafter dosing inlets 35.

The central duct 34 opens directly into the tubular portion 12; there is therefore a direct communication with the liquid L, which can be conveyed to the dosing inlets 35.

These dosing inlets 35 are closed by the inflow non-return valve 5, which allows an incoming fluid to pass into the dosing chamber 100 but prevents it from exiting therefrom by these dosing inlets 35.

Figure 9:
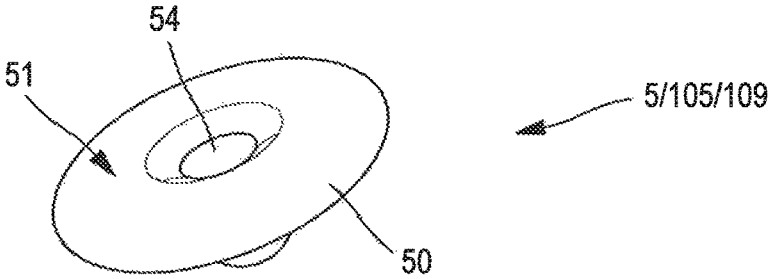
FIG. 9 is a perspective top view of the inflow non-return valve of the dosing chamber of the application device of FIG. 1.
Figure 10:
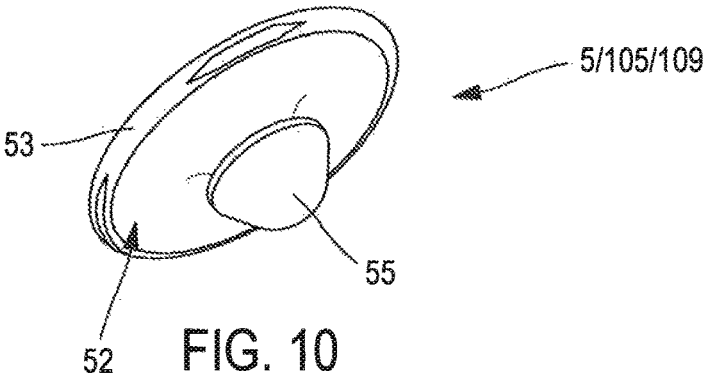
FIG. 10 is a perspective bottom view of the valve of FIG. 9.

The inflow non-return valve 5, shown further in FIGS. 9 and 10 has an inflow membrane 50 arranged downstream of these dosing inlets 35 and facing the latter, in such a way as to be able to close them.

Figure 8:
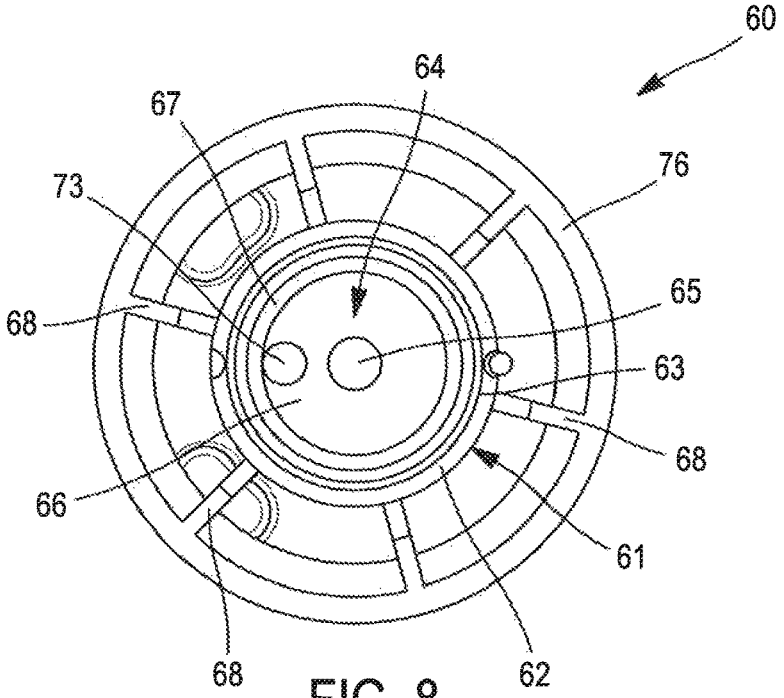
FIG. 8 is a bottom view of the base of the cylinder body of the device of FIG. 1.

As can be seen in FIGS. 3 and 8, the top wall 64 comprises an annular groove, hereinafter top groove 66, arranged around a central zone 65 of the top wall 64. Around this top groove 66 is arranged a flat portion forming a peripheral zone 67.

According to the disclosure, the central zone 65, the top groove 66 and the peripheral zone 67 can be arranged concentrically with respect to the axis of sliding A.

At the bottom of this top groove 66, i.e. at the apex of the dosing chamber in FIG. 2, an orifice is arranged that forms a dosing outlet 73, through which the fluids, the liquid after triggering or the air during triggering, can exit from the dosing chamber 100. In this example, there is only one dosing outlet 73.

In the first exemplary embodiment and more particularly in the example shown, the inflow valve 5 comprises a shape that is at least partially complementary with the top wall 64. According to the first alternative, this complementarity is substantially total. On the other hand, in the second alternative, shown in FIGS. 16 to 18 and which will be commented on further on, the top wall 264 is complementary only in the sides of the valve 5.

For example, as can be seen in FIGS. 9 and 10, the inflow non-return valve 5 comprises a central portion 54 of which the surface forms a disc of the same diameter as the central zone 65 of the top wall 64.

Around this central portion 54, is arranged the inflow membrane 50. This inflow membrane 50 comprises an upper flank 51 and opposite the latter, a lower flank 52, with these two flanks being separated by an edge 53. This edge 53 is circular and the inflow membrane 50 is arranged in such a way that this edge 53 is circumscribed in a circle arranged perpendicularly to the axis of sliding A.

The upper flank 51 is convex while the lower flank 52 is concave.

Here, the convex shape of the upper flank 51 is complementary with the top groove.

According to the disclosure, and as can be observed in FIG. 3, the upper surface of the inflow valve 5 can therefore be complementary with the surface of the top wall 64, in particular, as here, cover most of the surface thereof.

Here, the inflow membrane 50 does not extend to the inner surface of the sliding tube 61, in such a way as to cover the top wall only until the peripheral zone 67, in the end-of-travel position.

Figure 11:
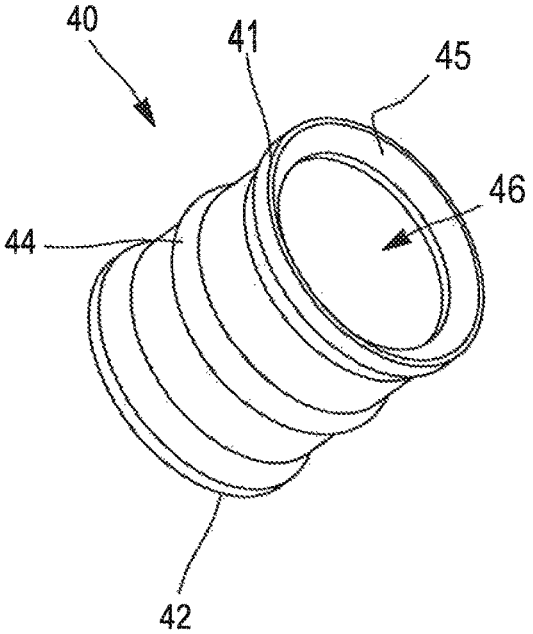
FIG. 11 is a perspective top view of a part of the piston of the device of FIG. 1.

The piston 3 can comprise an upper lip 41 arranged on the upper peripheral edge of the piston, as can be seen shown in FIG. 11.

A portion of the piston 3, here this upper lip 41, can exceed all around the edge 53, and, as can be seen in FIG. 3, when the cylinder body 6 is in the end-of-travel position, the upper lip 41 is arranged to cover this peripheral zone 67 of the top wall 64.

In the end-of-travel position, or retracted position, the inflow membrane 50 is housed inside the top groove 66, with the upper flank 51 thereof hugging the bottom of this top groove 66. The central zone 65 exactly covers the central portion 54. The upper lip 41 hugs the surface of the peripheral zone 67. It then follows that during the triggering, all of the air of the dosing chamber 100 is removed, and this all more easily so in the case where the dosing outlet 73 is arranged at the bottom of this top groove 66.

It is therefore possible to use all of the volume of the dosing chamber 100 during triggering, in order to increase the pressure after the exiting 73 from the dosing chamber 100 and remove all the more so easily the air inside the pump 1.

From the lower flank 52 extends downwards a protuberance forming a stud 55 that has a head with edges that are wider than its base. Thus, the stud 55 is mounted by clipping on the piston 3, as shown in FIGS. 2 and 3.

Figure 12:
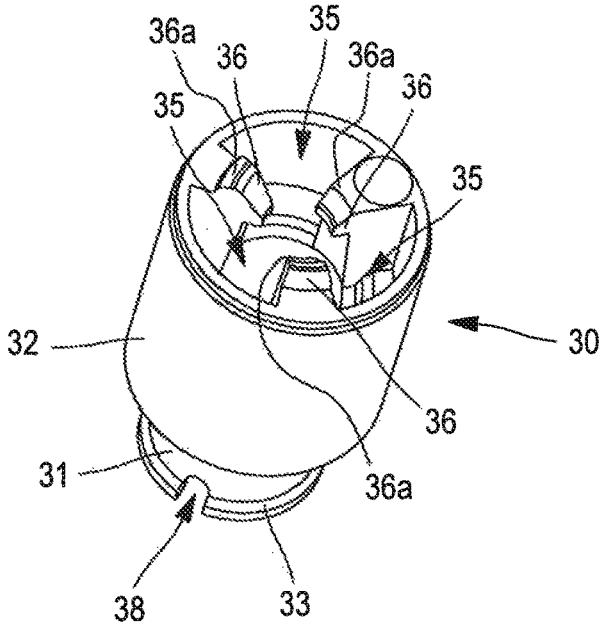
FIG. 12 is a perspective top view of another part of the piston of the device of FIG. 1.

According to the disclosure, in particular as in FIG. 12, the piston base 30 can comprise a sleeve 31 that is press fit on the tubular portion 12. According to an embodiment of the disclosure, the piston base can also comprise an upper part that is wider than the sleeve 31.

This upper part can comprise a sweep 32 that extends downwards around, at a distance and facing is of this sleeve 31, in such a way as to form an annular groove, in which is nested the apex of the tubular portion 12.

Here, so as to complete this fastening, nesting shoulders 33 are arranged at the bottom of the sleeve 31 and are clipped underneath complementary internal shoulders 75 arranged on the inner wall of the tubular portion 12.

This sleeve 31 can comprise as here, a slot 38 allowing for the coming closer of the nesting shoulders 33 by deformation of the sleeve 31.

The open end of this sleeve 31 is arranged at the bottom and opens into the tubular portion 12, with the inside of the sleeve 31 forming the central duct 34.

According to the disclosure, as here, the upper part of the base of the piston 3 can comprise clipping lugs 36, between which the stud is clipped. The passages 37 and the dosing inlets 35 are in this case arranged between these clipping lugs 36 and the stud 55.

These clipping lugs 36 can, as here, extend radially inwards without joining in such a way as to allow room for the insertion of the stud 55 of the inflow valve 5. Thus the inflow valve 5 is firmly fixed to the apex of the piston 3, with the inflow membrane 50 covering the dosing inlets 35.

Thus, the inflow membrane 50 is able to be deformed upwards by leaving the passage open to the liquid L through dosing inlets 35, when a pressure is exerted against its lower flank 52 or when a depression is exerted on the side of its upper flank 51. On the other hand, when a pressure is exerted in the dosing chamber 100, the force that is applied here from downstream to upstream on the inflow membrane 50 will thrust the latter above the dosing inlets 35 and against the piston 3, in such a way that the dosing inlets 35 will be closed. The inflow valve 5 therefore forms a non-return valve, allowing the liquid L to pass inside the dosing chamber 100 but preventing it from exiting via these dosing inlets 35.

According to the disclosure, in order to improve the tightness between the side wall 61 of the cylinder body and the piston 3, the piston comprises a second part 40, which forms a sealing member, here a tubular sealing member 40, shown in detail in FIG. 11. This tubular sealing member 40 is press-fitted directly around the upper part of the piston 3.

This tubular sealing member 40 comprises two open ends delimited here respectively by an upper lip 41 and a lower lip 42. These lips exceed the upper part at the top and at the bottom. This makes it possible to create a double tightness against the inner wall of the sliding tube 61.

Between these lips 41, 42, the sealing member can comprise an annular protrusion 44, of which the largest diameter is arranged in such a way as to be in contact with the inner wall of the sliding tube 61. This annular protrusion makes it possible to improve the guiding in sliding of the cylinder body 6.

Between these lips 41, 42 and this annular protrusion 44, the tubular sealing member 40 is at a distance from the inner wall of the sliding tube 61. A space is therefore created between the tightness zones formed by these lips, decreasing the risk of a formation of a continuous film of liquid between the latter.

Figure 13:
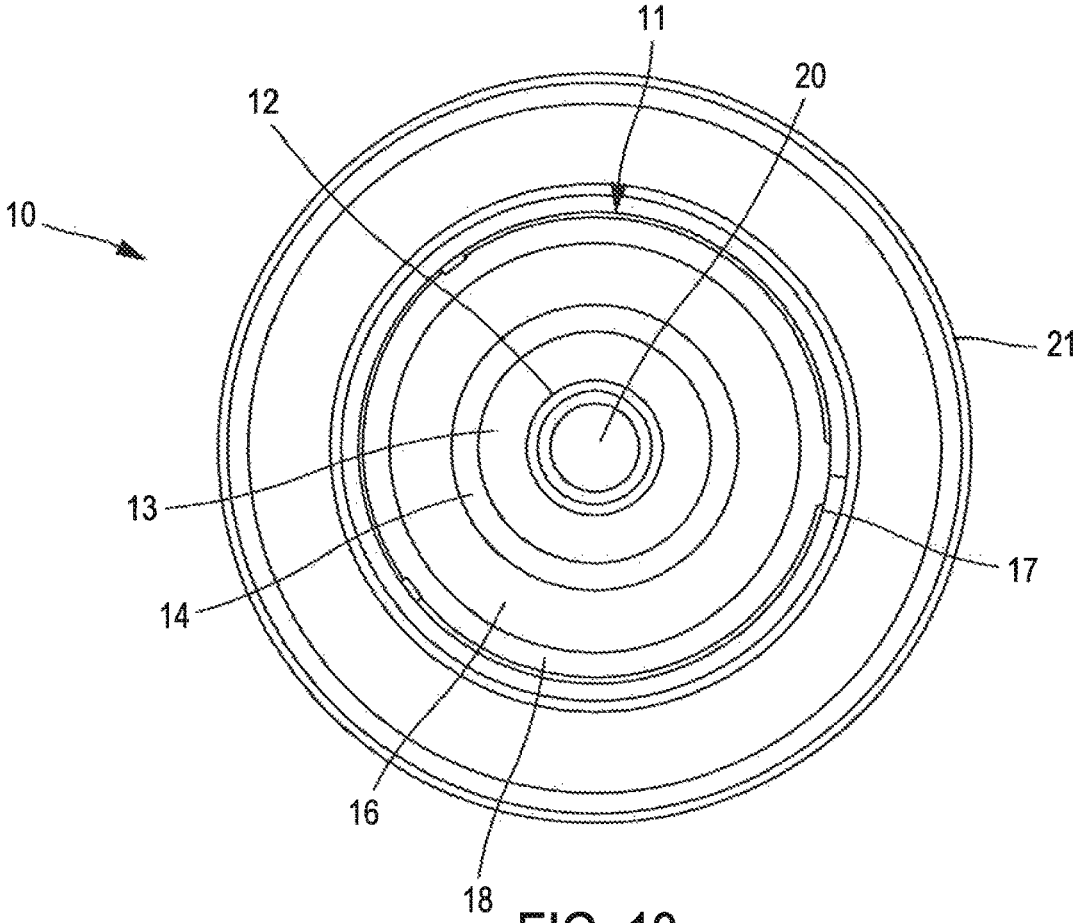
FIG. 13 is a top view of the connection member of the application device of FIG. 1.

As can be seen in FIGS. 2 to 7, as well as in FIG. 13, the container formed by the connection member 10 extends between an open end 11 and its bottom 19. The inside of the container is formed by side walls 17 having a shoulder that forms an end-of travel stop 18.

The tubular portion 12 can, as here, delimit the passage orifice 20.

A drum 14 is arranged concentrically around this tubular portion 12 in such a way as to form between this tubular portion 12 and this drum 14 a first lower groove 13, inside of which slides the sliding tube 61 between the end-of-travel position and the deployed position.

At the apex of this drum 14, the inner wall of the drum 14 comprises a protrusion 15 that protrudes inwards. This protrusion 15 is in contact with the outside of the sliding tube 61.

The sliding tube 61 comprises on its open end a bulge 71 that protrudes outwards, and that comes into contact with the protrusion 15 in the end-of-travel position.

Here, the pair of sealing members 70 of the cylinder body 6 comprises an upper sealing member 72 that surrounds a cooperation part 69 that forms the upper part of the base 60 of the cylinder body. The latter provides the tightness between the cooperation part and the dispensing head 8.

The pair of sealing members 70 of the cylinder body 6 comprises a sealing member that forms an annular protrusion 71 that thus forms the bulge at the end of the sliding tube 61.

The bottom of the sliding tube 61 comprises a protrusion 62 that reduces its outer diameter and which thus makes it possible to create a receiving portion 63 of the annular protrusion 71.

The pair of sealing members 70 can be created in a single part by over-molding on the base 60 of the cylinder body. For example, a groove can be arranged in the of the cylinder body 6 in order to connect the cooperation part 69 and the receiving portion. As can be seen in FIG. 1, an injection cord formed in this groove connects the upper sealing member 72 and the annular protrusion 71.

According to the disclosure, the diameter of the sliding tube 61 above the annular protrusion 71 can correspond approximately to the inner diameter delimited by the protrusion 15, in such a way that in the end-of-travel position the walls of the drum 14 are without stress, and in such a way that when the spring 4 returns the cylinder body 6 upwards, the sliding tube 61 slides against the protrusion 15 without stress on most of the movement. This thus facilitates the rising of the cylinder body upwards.

When the cylinder body 6 is close to its deployed position as shown in FIG. 2, the annular protrusion 71 comes into contact with the protrusion 15 and will progressively exert a stress on the latter outwards, thus reinforcing the tightness.

Here, as the material of the annular protrusion 71 is more flexible than that of the connection member, it is the ring bulge 71 that will be compressed. The tightness is thus reinforced.

Because of this, there is in the deployed position a double tightness on either side of the wall of the sliding tube 61 at its open end 74:

- inside, between the lower lip 42 and the inner wall of the sliding tube 61, and
- outside between the annular protrusion 71 and the protrusion 15 of the drum 14.

A space filled with air is created between this double tightness, with this space opening into the first lower groove 13. Because of this, any liquid passing the first tightness will fall to the bottom of this first lower groove 13. There is therefore very little chance that a film of liquid can create a junction between the lower lip 42 and the outside of this first lower groove 13, beyond the annular bulge 71.

A very good tightness has thus been provided which prevents contamination between the inside of the dosing chamber and the outside of the latter.

This is all the more so effective in the example shown, with the volume internet of the container communicating with the outside of the pump 1, since the bottom of the dispensing head 8 is mounted telescopically in the container.

The spiral spring 4 is arranged inside the container and around the drum 14. The spiral spring 4 bears on one side at the bottom of a second lower groove 16, formed between the drum 14 and the side wall 16 of the container.

The base of the cylinder body 60 comprises a collar 76 that is wider than the sliding tube 61. The spring bears against the other side against this collar 76. As here, the collar can comprise a set of stops formed by radial ribs 68, against which the spring 4 presses.

In the two alternatives of the first exemplary embodiment, the pump 1 is adapted for liquids that do not contain preservatives and which must consequently be kept away from outside air.

For this, the dosing outlet 73 is connected to the dispensing orifice 81 via communication spaces and an outflow non-return valve 9 directly closes this dispensing orifice 81.

According to the two alternatives of the first exemplary embodiment, these communication spaces can successively comprise three intermediate ducts and an upper space 82.

The upper space is delimited by the passage through the reducer 83, the tank membrane 96, and the passage in a front wall of the push-button 80 leading to the dispensing orifice.

The reducer 83 can, as here, have the shape of a ring, called otherwise reducing ring 83.

A first intermediate duct 84*a* is formed in the cylinder body and leads from the dosing outlet 73 to a second intermediate duct 84*b* arranged in a transversal wall of the push-button 80.

The second intermediate duct 84*b* opens into a third intermediate duct 84*c* formed inside the reducer 83 and opening into the upper space 82.

In the example shown of this first exemplary embodiment, and in its alternative, the terms "front" and "rear" are applied according to the direction of displacement of the obturator 90.

According to the two alternatives of the first exemplary embodiment, as here, the hermetic tank 86 can be mounted, here by nesting, in the housing 85 of the push-button 80, in such a way that the edges of the tank membrane 96 are pinched between a corresponding internal shoulder of the push-button 80 and the edge of the tank 86, in such a way that the tank membrane 96 hermetically closes the tank 86.

This tank membrane 96 is here integral with the obturator 90, which extends axially towards the dispensing orifice 81.

This obturator 90 comprises at its free end a nipple 91 arranged so as to be able to hermetically close the dispensing orifice 81.

Thus, when a fluid enters inside the upper space 82 and exerts a thrust on the tank membrane 96, the latter is deformed towards the bottom 89 of the tank 86, thus driving the retreat of the obturator according to the axis B and the release of the dispensing orifice 81.

The auxiliary returning member 97 is in a constant connection with the tank membrane 96 and comprises two stages 92, 93 that can be deformed elastically, in particular with different stiffnesses and/or geometries.

The first stage 92 maintains a constant return force of a predetermined value against the tank membrane 96, and consequently on the obturator 90.

The second stage 93 is inserted between the first stage 92 and the bottom 89 of the tank 86, and maintains a return force that is greater than that of the first stage 92, acting only when the tank membrane 96 is solicited.

The first and second stages 92, 93 are here of different geometries.

For example, the first and second stages 92, 93 can be from a central core 94.

The first stage 92 can extend radially around the latter by forming a cup 98 of which the outer edge is bearing on the inner wall of the tank 86, for example in grooves or against shoulders of this inner wall. This cup 98 is made from an elastic material, and its zone between the core 94 and the outer edge forms an elastic articulation.

The second stage 93 can extend axially from the same central core 94, by forming a bell of which the outer edge is bearing on the bottom 89 of the tank 86. This bell 99 is made from an elastic material, and its zone between the core 94 and the outer edge forms an elastic articulation.

On the one hand, as the tank 86 is hermetically closed, it is established that, when the device for dispensing is at rest, the pressure P2 of the tank 86 is equivalent to the pressure of the ambient air at the time of the initial assembly of the pump 1, i.e. equivalent to the initial atmospheric pressure.

On the other hand, there is no air intake in the container R of liquid, the latter having in particular a variable volume. Thus, the pressure P3 of the dosing chamber 100 follows the change in the pressure P1 of the environment around the pump 1.

Because of this, in this first exemplary embodiment, as well as in that of the second alternative, when the push-button 80 rises or when the device for dispensing 1 is placed in an environment with a low pressure P1 (P1 less than the initial atmospheric pressure), for example during travel in a plane, the pressure P3 of the dosing chamber decreases and becomes less than the initial atmospheric pressure, and therefore less than the pressure P2 of the tank which remains invariable and therefore equivalent to the initial atmospheric pressure, the tank being hermetically closed.

The difference in pressure between the pressure P3 of the dosing chamber and the pressure P2 of the tank generates a force on the tank membrane 96, deforming it towards the dispensing orifice 81 and thus reinforcing the support on the obturator 90, and therefore the tightness.

The auxiliary returning member 97 can be carried out in a single-block manner by molding a thermoplastic elastomer material (TPE) or thermoplastic vulcanized (TPV) material or with a silicone base or any other material that offers similar characteristics.

Likewise, the tank membrane 96 and the obturator 90 thereof can be carried out in a single-block manner by molding a thermoplastic elastomer material (TPE) or thermoplastic vulcanized (TPV) material or with a silicone base or any other material that offers similar characteristics.

The obturator can as here extend axially and be hollow. This makes it possible to house therein as here a reinforcement part 95 in a more rigid material. This reinforcement part 95 extends from said tank membrane 96 and is mechanically connected to the first stage 92 of the auxiliary returning member 97.

The part here forming the tank membrane 96 and the obturator 90 thereof and the reinforcement part 95 can be obtained via bi-material injection.

The material comprising the push-button 80, the tank membrane 96, the reducer 83, the cylinder body 6, the inflow non-return valve and the base 30 of the piston 3 can comprise antibacterial agents.

According to an embodiment of the disclosure, as in this example and that of the second alternative, the reducer 83 can be placed inside the volume defined between the tank membrane 96 and the inner walls of the push-button 80 housing 85.

This reducer 83 makes it possible to carry out the tank membrane 96 with a diameter that is larger than the volume available around the obturator 90. In other words the housing 85 has a size that makes it possible to have a size of the tank membrane 96 and the reducer reduces the space available between the walls of the housing and the obturator 90.

Thus by pressing on the push-button driving the rising liquid L in this upper space 82, more pressure is exerted on the tank membrane 96, thus facilitating the opening. However, by decreasing the free volume around the obturator 90, the volume of the communication spaces to the dispensing orifice 81 is also decreased. This further increases the purging capacity linked to the arrangement of the cylinder body 6 and its piston 3 according to the disclosure.

In this example, the push-button 80 is firmly fixed with respect to the cylinder body 6 by clipping its collar 76 inside a suitable groove of the push-button 80. This is also the case in the second alternative.

Details on the operation of the pump 1 shall now be given in reference to FIGS. 2 to 7.

In FIG. 2, the push-button 80 is in deployed position, as well as the cylinder body 6 integral with this push-button 80, the top wall 64 being at a distance from the piston 3.

The dosing chamber 100 is therefore at its maximum volume.

The ducts formed by the tubular portion 12, the central duct 34 and the passages 37, as well as the dosing chamber 100 and the various communication spaces 84*a*, 84*b*, 84*c*, 82 are filled with air.

Then the triggering operation starts, consisting in purging these spaces filled with air from the air that they contain.

A downward pressure is then exerted on the push-button 80 with respect to the orientation of the pump in FIG. 2. The cylinder body 6 then leaves the deployed position, shown in FIG. 2, to the end-of-travel position, shown in FIG. 3, by sliding along the piston 3.

By doing so, the pressure increases in the dosing chamber 100, thus thrusting the inflow membrane 50 against the dosing inlets 35.

The air is then compressed in all of the communication spaces, in particular in the upper space 82, driving the deformation towards the rear of the tank membrane 96 and therefore the retreat of the obturator 90 along the axis of obturation B and towards the rear, thus releasing the nipple 91 from the dispensing orifice 81.

By doing so, the cup 98 and the bowl 99 are deformed, with the core 94 moving away from the dispensing orifice 81 towards the bottom 89 of the tank 86, the edges of the cup 98 and of the bowl 99 remaining with a fixed pressing against the inner wall of the tank 86. Thus the air is expelled by the dispensing orifice 81.

Once the air is removed, the pressure becomes equal again between the outside of the pump 1 and the inside of the upper space 82 driving the return of the obturator to the dispensing orifice 81 under the return force exerted by the cup 98 and the bowl 99. At the end of the returning movement of the obturator 90, the nipple 91 then plugs the dispensing orifice 81, as shown in FIG. 4.

Figure 4:
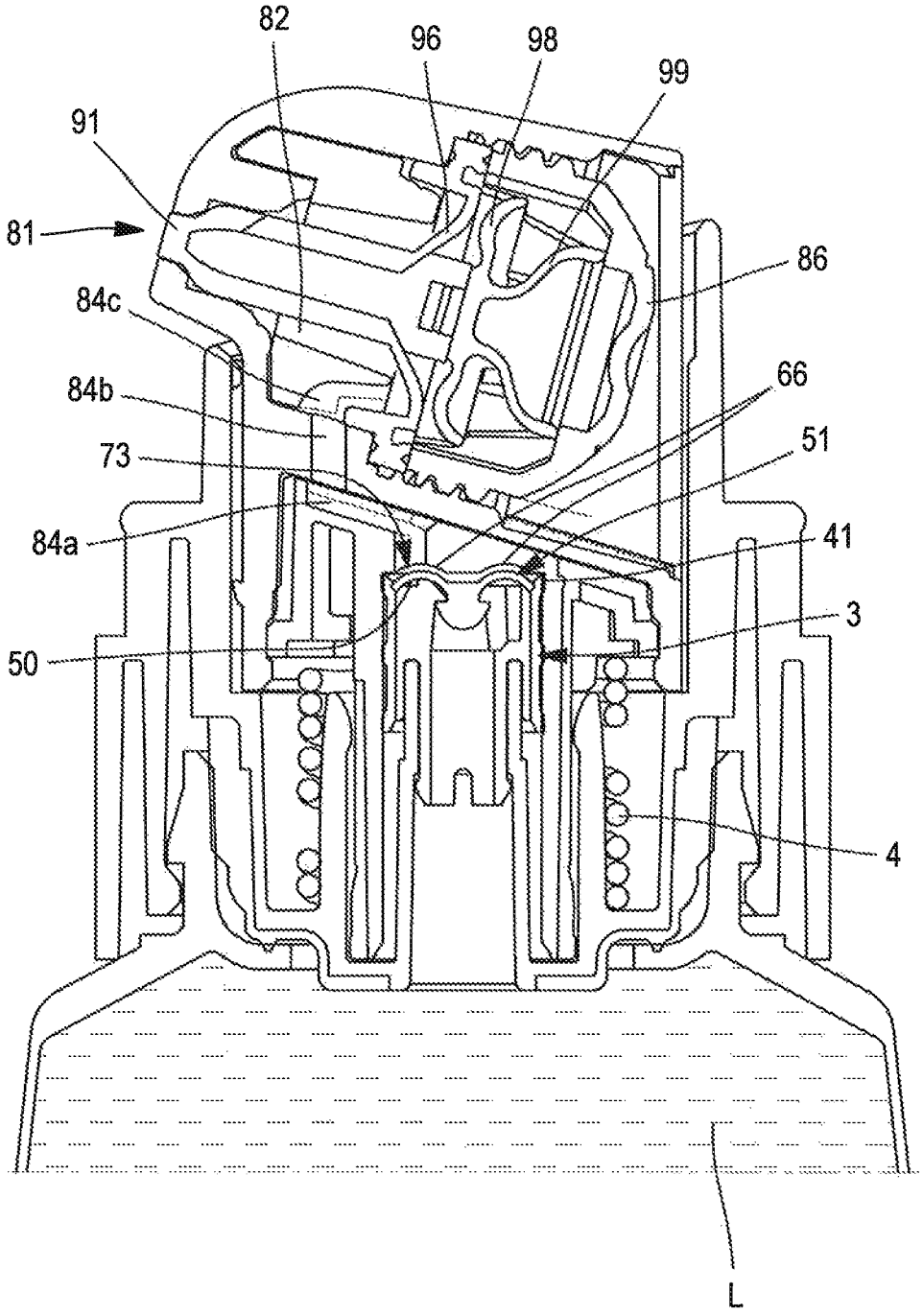

In FIG. 4, the air has been expelled and the pump is hermetically closed.

During this descent of the cylinder body 6, the spring 4 was compressed against the bottom 19 of the connection member 10, by being guided along the drum 14.

When the push-button 80 is released, the spring 4 returns the cylinder body upwards and therefore drives the push-button 80 upwards.

Because of this, the top wall 64, that came into complementary contact with the inflow membrane 50 and the upper lip 41, moves away from the piston little by little increasing the volume of the dosing chamber 100. A depression is thus created, driving the exercise of a force on the inflow membrane 50, which is then deformed towards the top wall 64, in such a way that its edge 53 moves away from the piston 3, the concavity of the upper flank 51 and the convexity of the lower flank 52 decreasing. Thus, the inflow membrane 50 releases the dosing inlets 35, which drives the aspiration of the air into all of the communications leading to the liquid L. The latter is thus also aspirated and rises in the tubular wall 12, then in the central duct 34, then in the passages 37, passes through the dosing inlets 35, and begins to fill the dosing chamber 100.

Moreover, this depression solicits a deformation of the tank membrane 96 towards the dispensing orifice 81, and therefore presses further the obturator 90 in the latter. The triggering is therefore reinforced by as much. This is all the more so effective as the tightness of the inflow valve 5 is improved.

Figure 5:
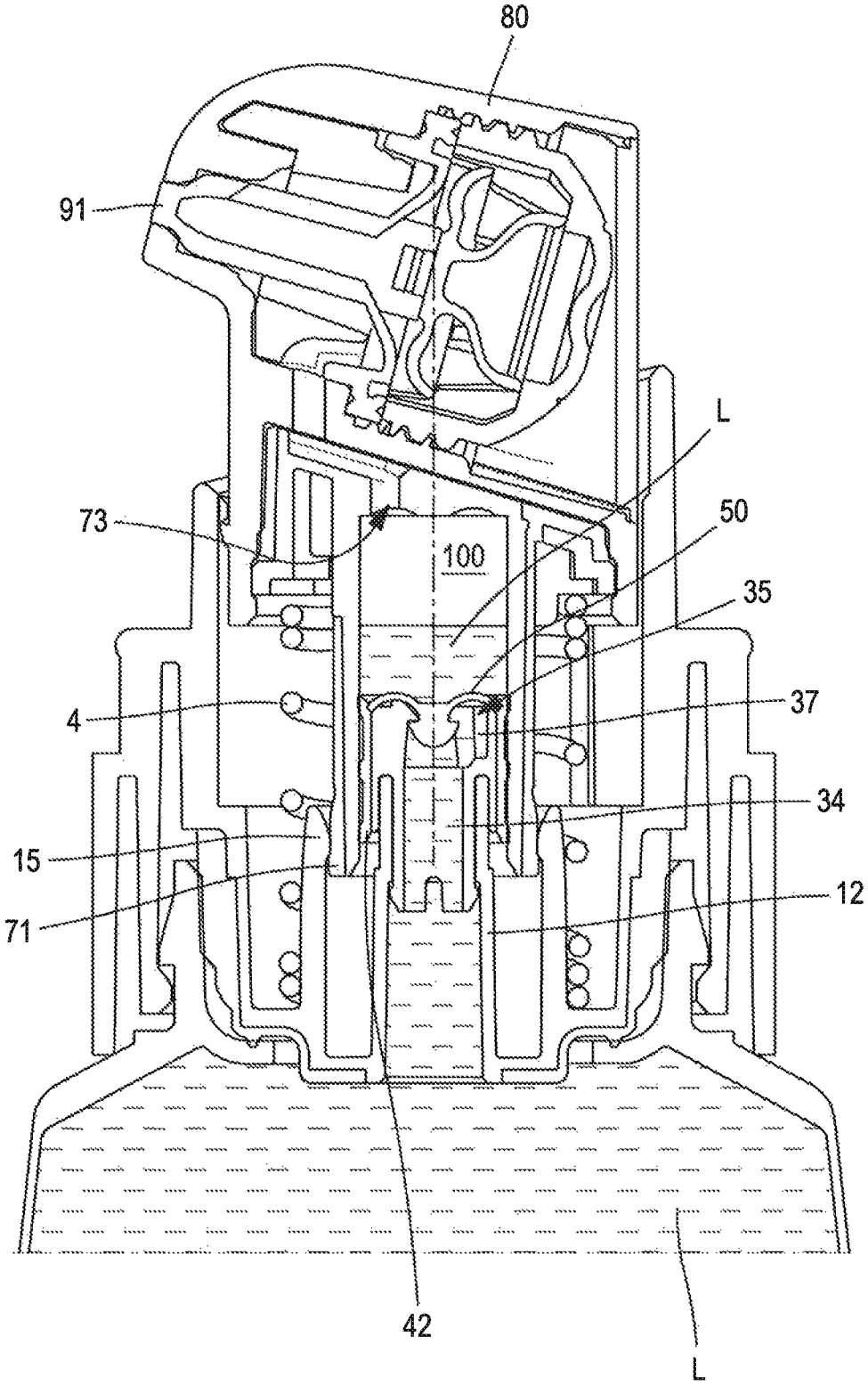

In a first step, it is the equivalent of the volume of the dosing chamber 100 in liquid L that will rise in the ducts leading from the passage orifice 20 to the dosing inlets 35. After their first aspiration, once the cylinder body 6 has returned to the deployed position, the dosing chamber 100 will therefore not be entirely filled, as can be seen in FIG. 5.

At least one other downward pressure is here required in order to fully purge the air. This number of downward pressure is not limiting.

When the cylinder body 6 descends again on the piston 3, it drives the compression of the air remaining in the dosing chamber 100 and in the various communication spaces 84*a*,

84*b*, 84*c*, 82, which again drives the opening of the dispensing orifice 81 by retreat of the obturator 90.

The air is first removed. Then the piston continuing to approach the top wall 64, the liquid L present in the dosing chamber 100 reaches the top wall 64, passes through the inlet via the dosing outlet 73, rises along intermediate ducts 84*a*, 84*b*, 84*c*, then fills the upper space 82 around the obturator and reaches the dispensing orifice 81. The air has thus been entirely expelled.

Figure 6:
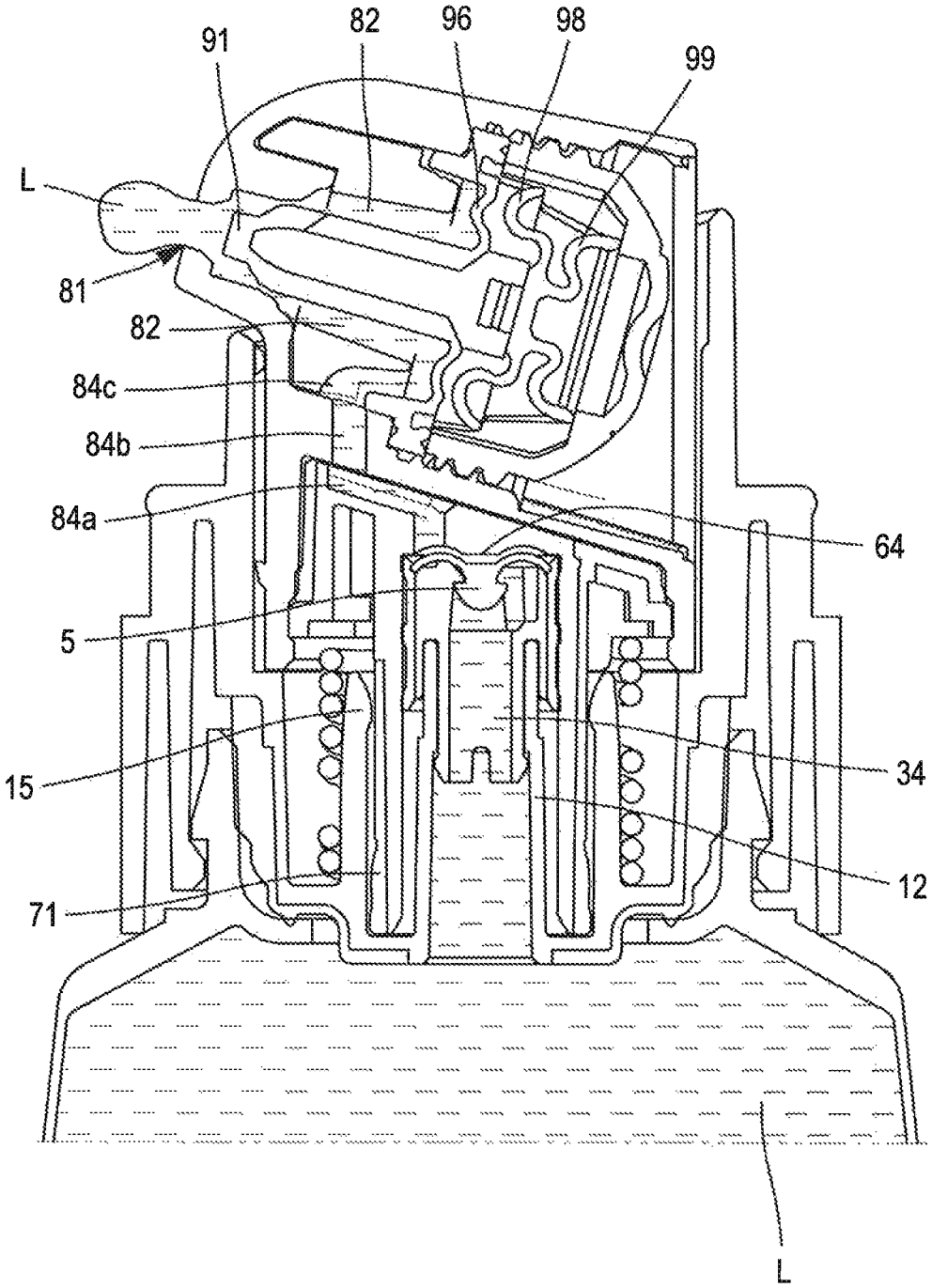

If as here there is still a stroke length for the cylinder body 6, the liquid will start to flow, until the cylinder body 6 arrives in the end-of-travel position, shown in figure, as in FIG. 6.

In FIG. 6, the air has therefore been entirely purged and liquid L fills all of the communication spaces 84*a*, 84*b*, 84*c*, 82 between the dispensing orifice 81 and the dosing outlet 73, as well as all of the passages leading from the dosing inlets 35 to the container R. Triggering is complete.

Figure 7:
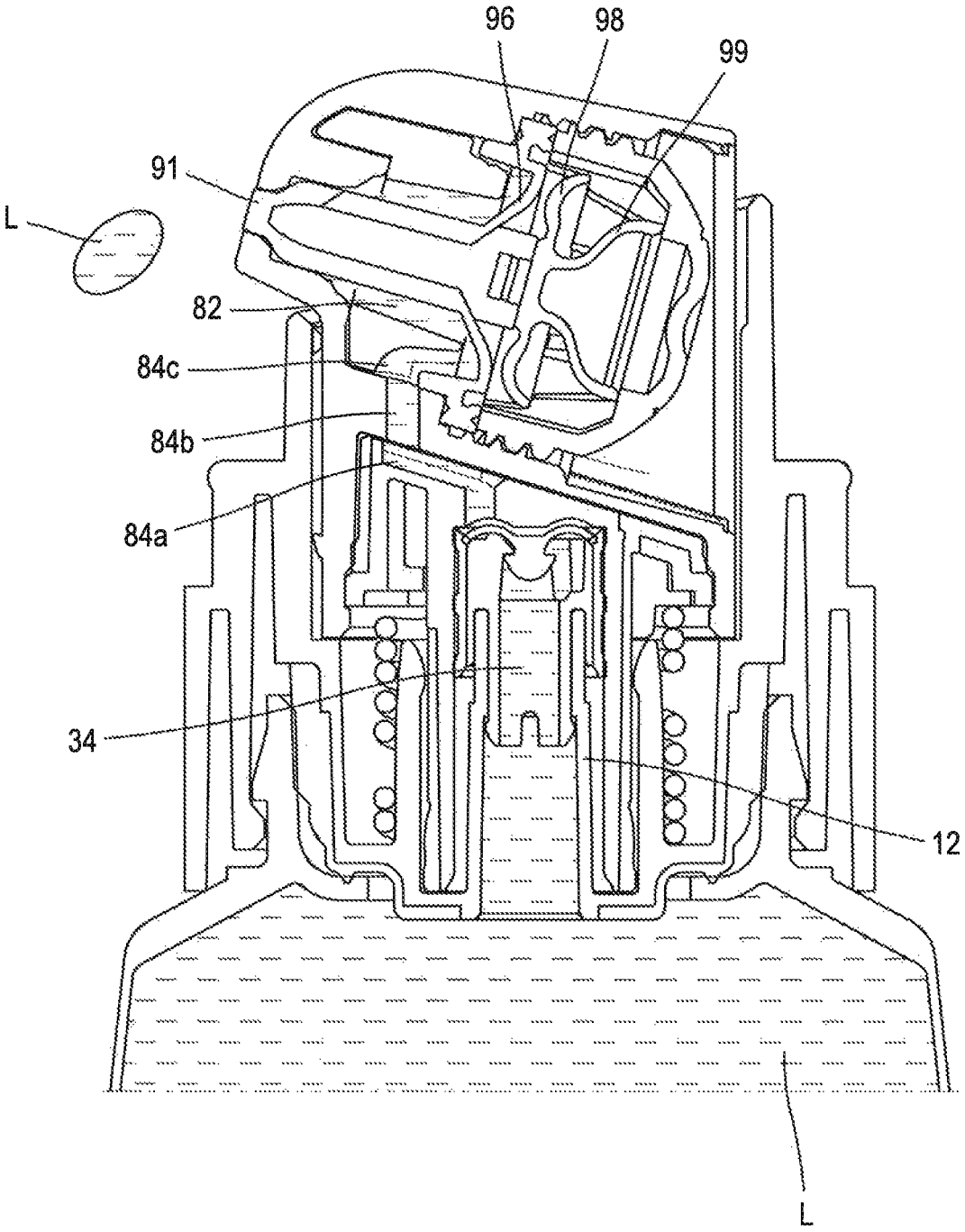

At the end of travel, the liquid L no longer bears on the tank membrane 96, which as hereinabove is returned towards the front by the auxiliary returning member 97, again driving the closing of the dispensing orifice 81, as shown in FIG. 7.

Later and in a manner not shown when the pressing on the push-button 80 stops, the spring 4 again returns the cylinder body 6 upwards, driving the aspiration of the liquid L in the dosing chamber 100, until it is entirely filled. As the pump 1 is triggered, each press will drive a dispensing of a volume of liquid L equal to the volume of the dosing chamber 100.

Figure 16:
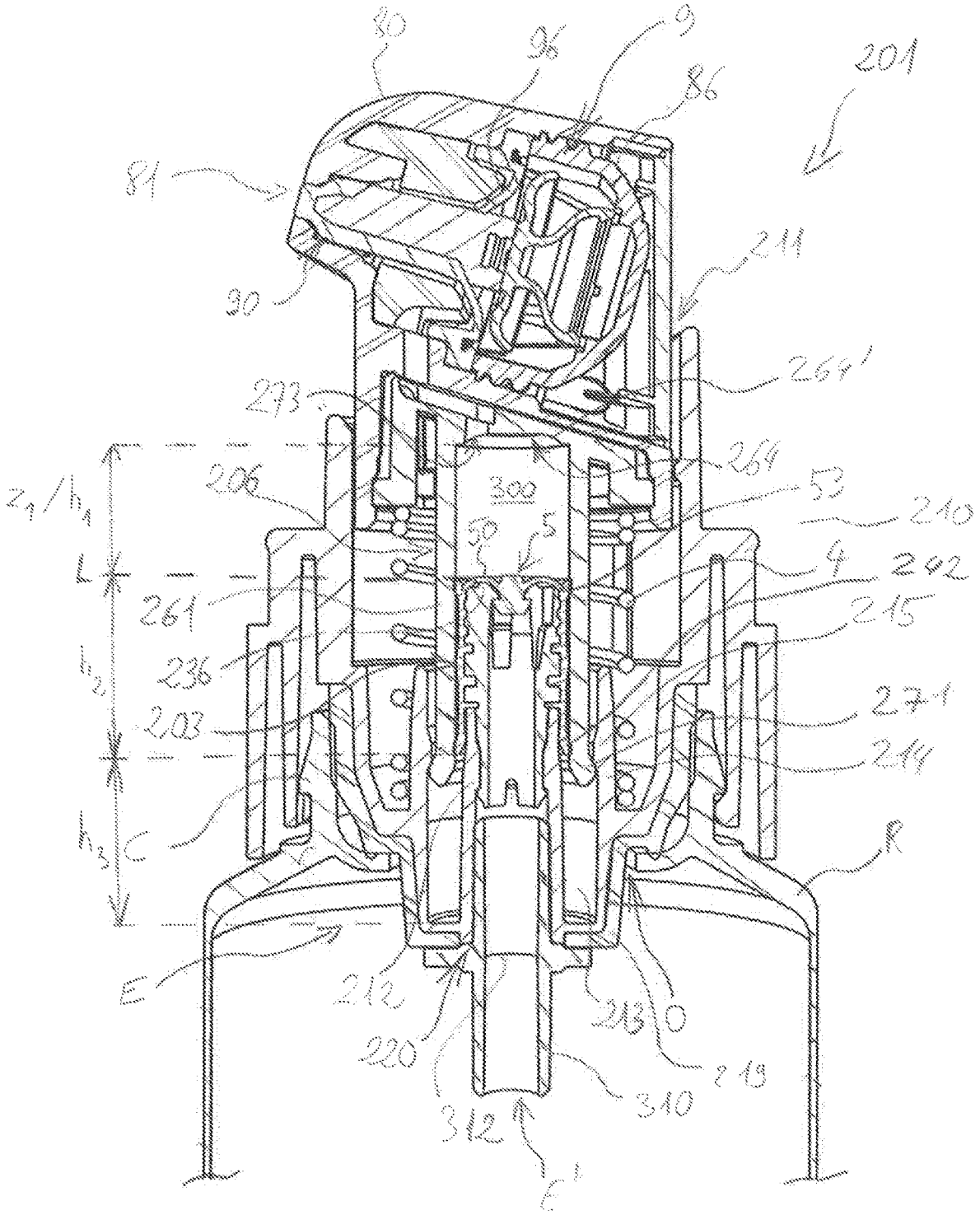
FIG. 16 is a cross-section view of a device for dispensing according to a second alternative of the first exemplary embodiment.
Figure 17:
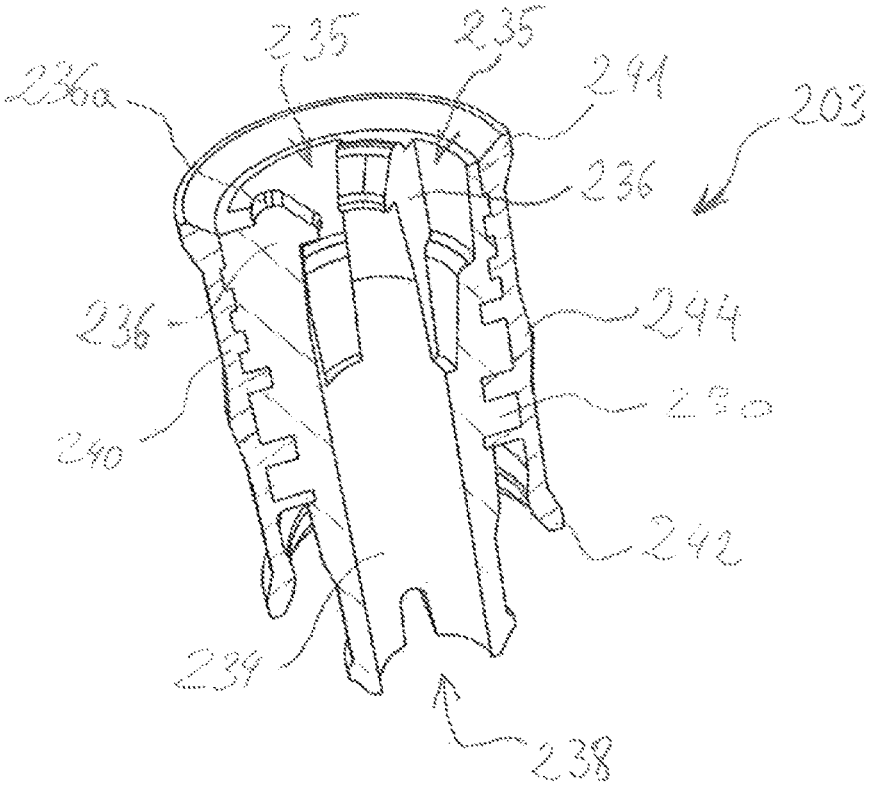
FIG. 17 shows a cross-section view in perspective of the piston of FIG. 16.
Figure 18:
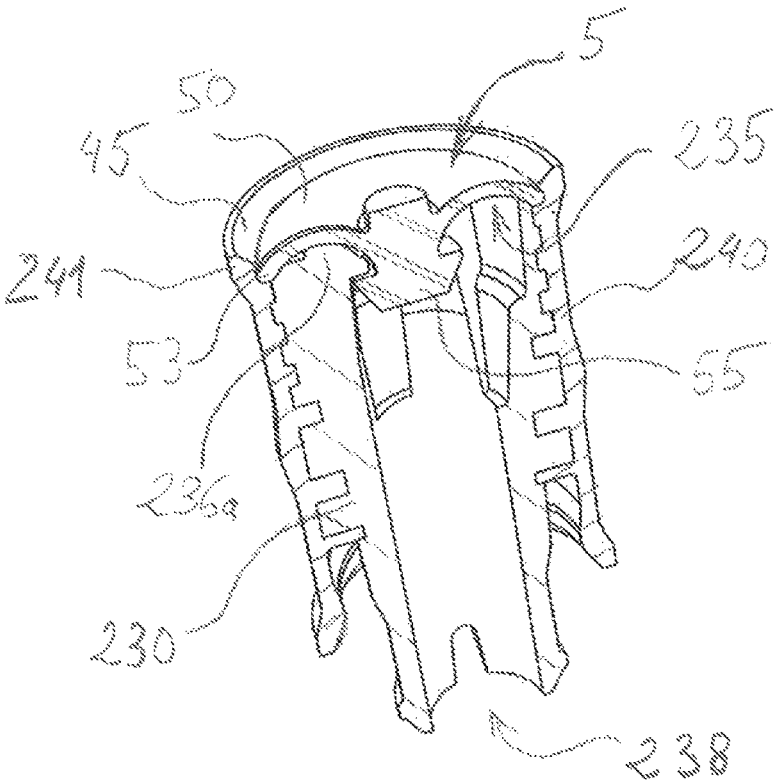
FIG. 18 shows FIG. 16, with the valve mounted on the piston.

FIGS. 16 to 18 therefore show a second alternative similar to the first alternative of the first exemplary embodiment. A complete description of these FIGS. 16 to 18 is therefore not included. The characteristics of the example of the first alternative described hereinabove are therefore applicable to the example of the second alternative, unless mentioned otherwise hereinafter.

In particular, the push-button 80, the outflow non-return valve, with its obturator 90 with a hermetic tank 96, and the inflow non-return valve 5 are identical between the alternative of FIGS. 1 to 13 and that of FIGS. 16 to 18. The same references are therefore used for these elements.

In these two alternatives, as can be seen in FIGS. 11 and 17, the piston 3, 203, is therefore in two parts, respectively 30 and 40 and 230 and 240.

The tubular sealing member 40, 240 has a portion with a flared surface 45, 245 upwards, here formed at the top of the upper lip 41, 241. This makes it possible to provide the tight clamping of the cup edges 53 against this flared surface 45, 245. This reinforces the tightness resulting from the prestress of the inflow valve 5 against the piston 3, 203. This pre-stressed clamping can be seen in particular in FIG. 2, for the first alternative, and in FIG. 18, for the second alternative. The tightness of the inflow valve 5 and therefore the triggering are as such optimized.

Moreover, this flared surface 45, 245 with this inflow valve 5 in a cup, makes it possible to more easily carry out a tight clamping around dosing inlets 35, 235, formed between the clipping lugs 36, 236.

In order to reinforce the effectiveness of the inflow valve 5, the clipping lugs 36 and 236 are provided with a convex upper portion 36*a*, 236*a*, here formed by a rounded protrusion, of which the convexity is arranged facing the concavity of the concave shape of the membrane 50. Thus, as can be seen in particular in FIGS. 2, 3, 16 and 18, the top of this convex shape follows the bottom of the membrane 50 of the valve 5. This allows it to retain its shape during the compression and improves tightness, triggering and precision of the dosing.

In this second alternative embodiment, contrary to the first one, the length h2 of the sealing member 240 is greater than the travel h1 of the piston 203. Because of this, when the cylinder body 206 is in the retracted position, against the piston 203, namely in the end-of-travel position, the lower lip 242 of the tubular sealing member 240 is below the low position L of the top of the upper lip 241, namely the position that this lip here 241 has in the deployed position. As during use, the product comes into contact only with the parts of the walls of the dosing chamber 300 above this low position L, which corresponds to a contact zone z1 with the dosed product, it follows that this lower lip 242 never comes inside this contact zone z1. Thus, in the case where a film of product were to be formed between the tubular sealing member 240 and the walls of the sliding tube 261, the latter is not removed downwards by the lower lip 242 and remains imprisoned between the annular protrusion 244 and the lower lip 242. Thus an additional obstacle is added to products leaks, in particular towards the first lower groove 213. The hygiene of the device 201 is thus improved.

The connection member 210 also forms in this second alternative a container that receives the push-button 80 and the spring 4 via the open end 211 thereof. However the bottom 219 thereof is different in that it is extended downwards with respect to the first alternative. Indeed, in order to carry out the tubular sealing member 241 with a longer length h2, the tubular portion 212, the drum 214 and the first lower groove 213 formed between them, are extended downwards, in such a way that the height h3 between the bottom of the lower lip 242, in the deployed position, and the bottom of this first lower groove 213 is greater than the travel h1 of the cylinder body 206.

The same additional means of tightness 215, 271 can be added at the top of this first lower groove 213, here on the outside of the bottom of the sliding tube 261.

Here, the top wall 264 was simplified. It has the shape of a dome, with the dosing outlet 273 arranged in its peripheral rounded portion 264'. The latter is of complementary shape with the external lateral sides of the concave shape of the membrane 50, in such a way that these external lateral sides hug the peripheral rounded portion 264' and plug the dosing outlet 273 as close as possible.

Moreover, an added tube 310 is mounted in the passage orifice 220 located at the bottom 219 of the connection member 210. This passage orifice is intended to communicate with the intermediate opening O of the container R, in such a way that the lower end of the tube 310 forms the inlet E' of the product in the device for dispensing 201.

The tube 310 can, as here, have an inner section 312 of a diameter that is at least 20% less than that of the passage orifice 220.

In particular, here the tube is press fitted in the inner duct of the tubular portion 212, through the passage orifice 220, in particular until in the vicinity of the lower opening 238 of the central duct 234 of the piston 203, which is clipped in the inner duct of the tubular portion 212.

The tube 310 is extended below the passage orifice 220.

As the pump only has two valves 5, 9 and the outflow valve 9 communicates directly with the dosing chamber 300, the depression created in the latter during the rising of the push-button 80 reinforces the closing of the outflow valve 9 and here allows the nipple of the obturator 90 to enter into the dispensing hole 81 in order to having optimum tightness.

Without the added tube 310, this depression can be insufficient for fluid products, such as water, to provide an optimum tightness. By adding the added tube 310 of a smaller section 312, an additional load loss is provided and reinforces the closing of the outflow valve 9.

Note that this makes it possible to increase this depression by retaining the flexible inflow valve 5, which allows for better triggering of the pump with the air.

Comparative studies on the operation of this added tube 310 have been conducted.

A 3 millimeter (mm) section of this added tube 310 provides an additional depression on the dosing chamber of:

85 milli bars (mbar) with a viscous cream 18 mbar with a fluid cream 1.7 mbar with water A 1 mm section of this added tube 310 provides a vacuum on the dosing chamber of:

511 mbar with a viscous cream 108 mbar with a fluid cream 10 mbar with water

For fluid products such as water, from 8 mbar of depression on the added tube the outflow valve 9 is optimally closed, thus substantially reducing the risk of bacterial back-contamination.

Thus by choosing a suitable section 312 of the added tube 310, the latter operates in association with the inflow valve 5 in order to generate a sufficient load loss in the dosing chamber 300, for all of the liquids as fluid as water and up to very viscous products, in order to optimize the closing of the dispensing orifice 81 without penalizing the triggering with the air, which is critical for a pump with a very small dose and an end closing that is sealed from bacteria.

Figure 14:
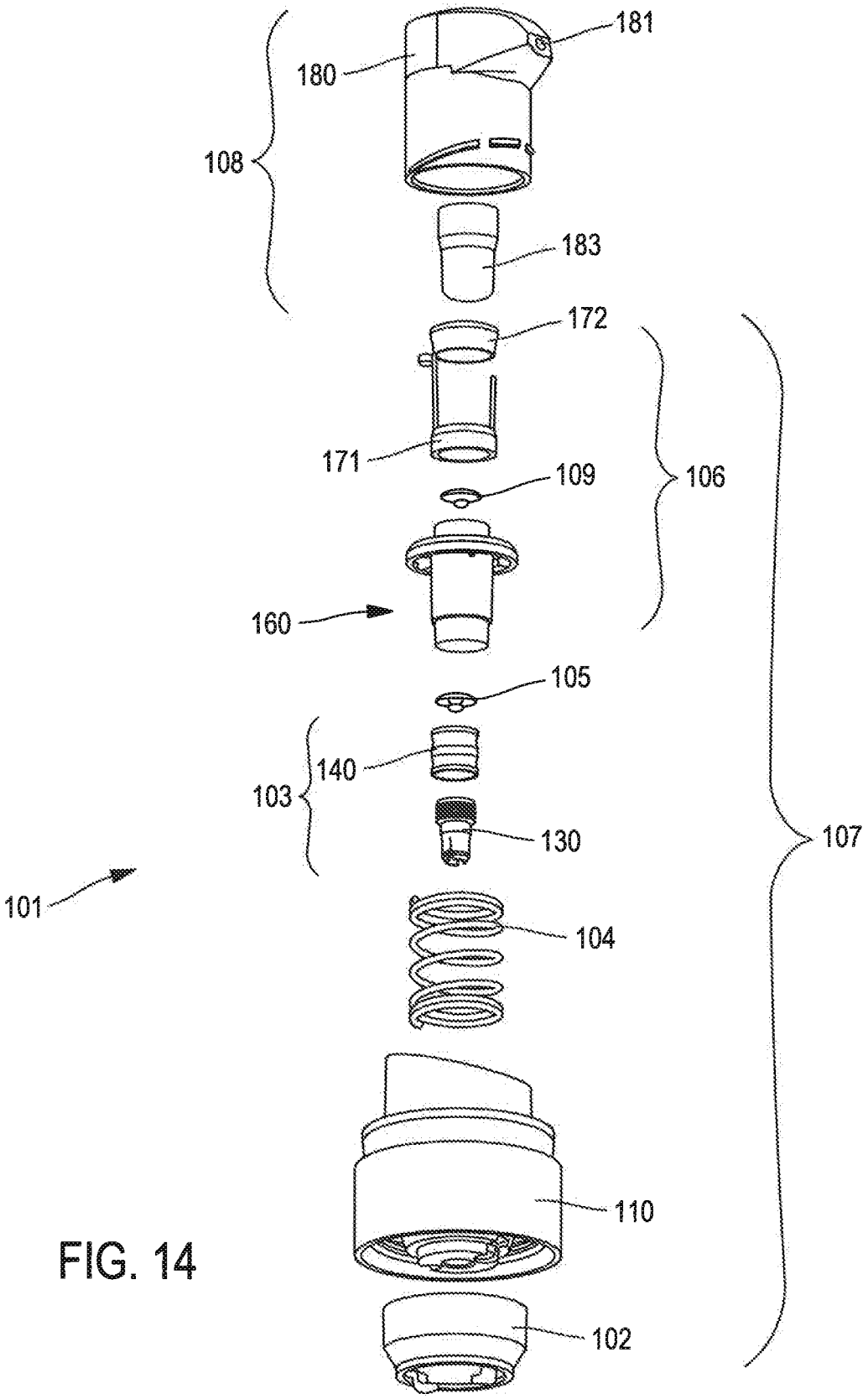
FIG. 14 is an exploded view of an example of a device for dispensing according to a second embodiment, corresponding to a second exemplary embodiment of the disclosure.
Figure 15:
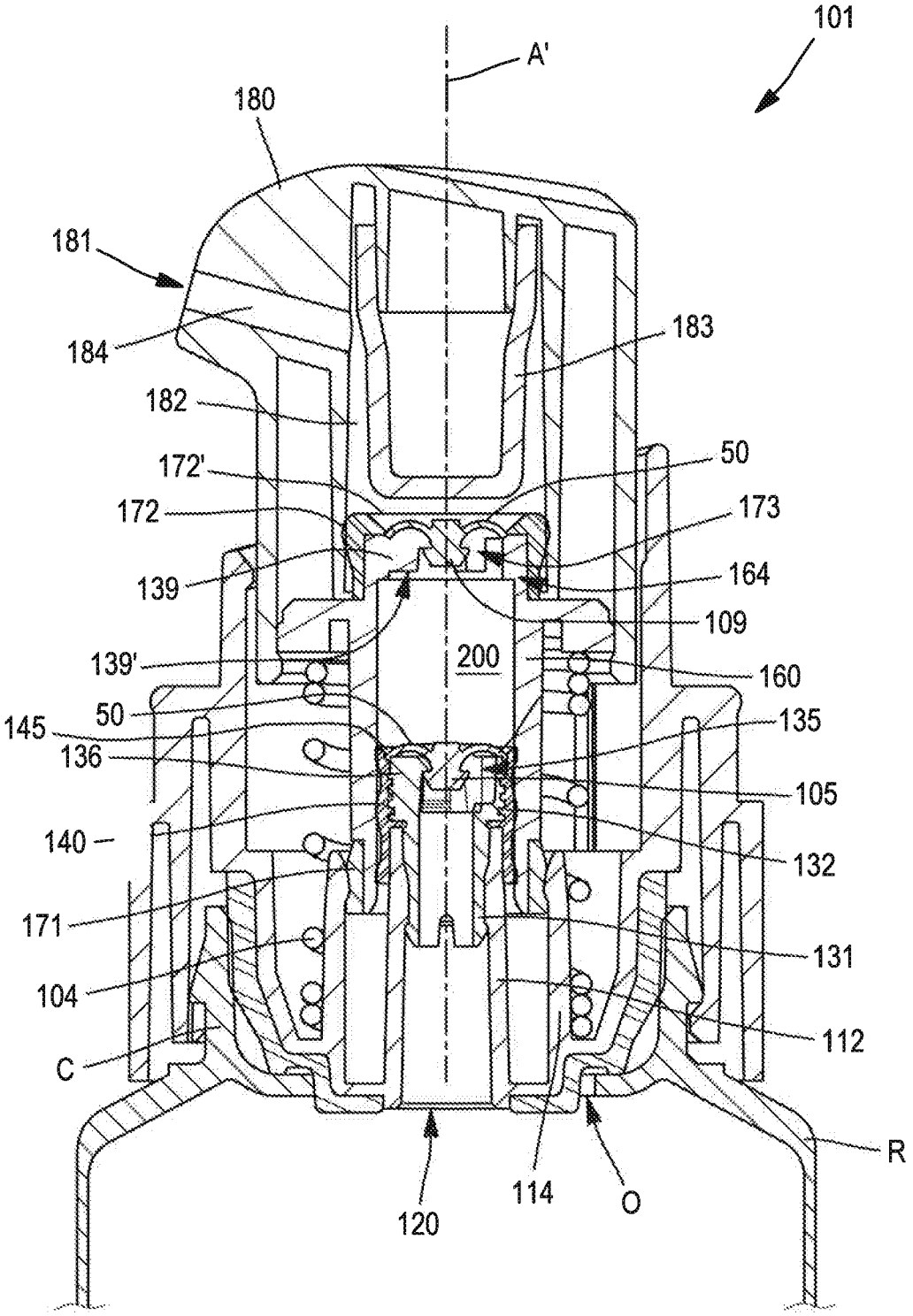
FIG. 15 shows a vertical cross-section view of FIG. 14, the device for dispensing being mounted on a container.

According to a second exemplary embodiment, of which an example is shown in FIGS. 14 and 15, the device for dispensing 101 comprises a dosing part 107 that is in part identical to that of the first exemplary embodiment. However, the dispensing head 108 is different.

In this second exemplary embodiment, a single outflow non-return valve 109 is mounted at the outlet of the dosing chamber 200, at a distance from the dispensing orifice 181.

This second exemplary embodiment has the advantage of being simpler. This second exemplary embodiment will preferentially be used with liquids or cremes that contain preservatives.

As in the first example shown, the dosing part 107 and the dispensing head 108 thus also form together a pump 101, corresponding to the device for dispensing 101.

In FIG. 15, this pump 101 is mounted on a container, here a container R, intended to be filled with a liquid, thus forming an assembly for conditioning this liquid.

The elements identical to those of the example shown of the first exemplary embodiment will there not be systematically included. Other than the differences that shall be mentioned, the detailed characteristics of the example shown in FIGS. 1 to 13 therefore apply to the example shown in FIGS. 14 to 15 of this second exemplary embodiment.

The dosing part 107 here comprises a neck seal 102, a connection member 110, a spiral spring 104 that are practically identical to those of the first exemplary embodiment and arranged together in the same way, as can be seen in FIG. 15.

The dosing part 107 also comprises a cylinder body 106 inside of which is mounted a piston 103.

According to a principle of the disclosure, as in the first exemplary embodiment, the piston 103 is fixedly mounted in the connection member 110, the cylinder body 106 being movable by sliding around this piston 103, according to an axis of sliding A'. This axis of sliding corresponds here to the longitudinal axis of the device for dispensing 101.

The piston 103 is close to that of the first exemplary embodiment.

On the other hand, if in the same way as in the example of the first exemplary embodiment, the piston base 130 comprises a sleeve 131 fitted on the tubular portion 112 of the connection member 110 and an upper part that is wider than the sleeve 131, this piston base 130 is on the other hand devoid of a sweep. In addition, it is provided with ribs 132 arranged on the perimeter of the upper part of this piston base 130.

In this second example, the tubular sealing member 140 differs from the one 40 of the first alternative of this first exemplary embodiment in that it comprises ribs on its inner surface cooperating with the ribs 132 of the piston base 130. This makes it possible to reinforce the press fitting of the tubular sealing member 140 on this piston base 130. These ribs are present on the second alternative of the first exemplary embodiment shown in FIGS. 16 to 18.

For the rest, the outer surface of the tubular sealing member 140 is identical to that of the first exemplary embodiment, in particular as shown in FIG. 11, and the same corresponding characteristics apply here.

Moreover, the piston base 130 also comprises a first series of clipping lugs 136 of a shape similar to those 36 of the piston 30 of the first exemplary embodiment, and thanks to which is fixed, as in the first example, a first inflow non-return valve 105. This valve 105 is here of a shape identical to that of the inflow non-return valve 5 of the first exemplary embodiment.

In other words, the aspiration of fluid from the container R is done in the same way as in the first exemplary embodiment, in particular regarding the sliding of the cylinder body 106 around the piston 103 from the end-of-travel position to the deployed position, and regarding the opening of the dosing inlet 135 by the deformation of the inflow non-return valve 105.

This is also the case for the delivery of the fluid concerning the movement thereof from the deployed position to the end-of-travel position.

In a second exemplary embodiment, as shown, it is therefore possible to find common advantages with the first exemplary embodiment, and in particular those linked:

- to the sliding of the cylinder body 106 with respect to the piston fixe 103,
- to the double tightness between the lips of the tubular sealing member 140,
- to the cooperation in tight clamping of the flared surface 145 with the cup edge 53,
- to the double tightness created on the one hand between the bottom of the cylinder body 106 and the tubular portion 112, and on the other hand, between the bottom of the cylinder body 106 and the carried drum 114, with this tubular portion 112 and this drum being carried by the bottom of the connection member 110.

On the other hand in the second exemplary embodiment, the arrangement on the outlet 173 of the dosing chamber 200 differs from the first exemplary embodiment, as can be seen in the example shown.

Indeed, a second non-return valve, hereinafter outflow non-return valve 109, is fixed above the cylinder body 106, in such a way as to allow for the opening and the closing of the outlet of the dosing chamber 200, hereinafter dosing outlet 173.

According to this second exemplary embodiment, as in the example shown, the apex 164 of the dosing chamber 200 can be formed by a second series of clipping lugs 139 of a shape similar to those 136 of the piston 103 that allow for the fastening of the inflow non-return valve 105.

Here, this apex also forms the apex of the cylinder body 106.

In this example, several dosing outlets 173 are arranged between some or all of the clipping lugs of this second series 139.

These dosing outlets 173 are closed by the outflow non-return valve 109, which allows a fluid to pass exiting from the dosing chamber 200 but prevents it from entering therein by these dosing outlets 173.

This outflow non-return valve 109 can be formed in a manner similar to the inflow non-return valve 105, in particular with a central portion and a membrane arranged around this central portion, hereinafter outflow membrane.

In the example shown, the non-return valves 105 and 109 are identical and interchangeable. Having identical non-return valves here allows for a standardization of these parts.

However in a manner not shown, in the second exemplary embodiment, this outflow non-return valve is not necessarily of a shape identical to that of the inflow non-return valve. It can also be of identical shape but in different proportions.

In this example, these non-return valves 105 and 109 are identical to the inflow non-return valve 5 of the first exemplary embodiment. Reference can be made for this to FIGS. 9 and 10, for these valves 105 and 109. The references of the FIGS. 9 and 10 are hereinafter included for the details of the characteristics of non-return valves 105 and 109.

Thus, the outflow membrane 50 is able to be deformed upwards by allowing the passage open to the liquid through dosing outlets 173, when a pressure is exerted in the dosing chamber 200 against the lower flank 52 thereof. On the other hand, when the pressure is negative in the dosing chamber 200, the force that is applied here from downstream to upstream on the membrane 50 of the outflow non-return valve 109 will thrust the latter above dosing outlets 173 and against the apex of the cylinder body 106, in such a way that the dosing outlets 173 will be closed.

The lugs of the second series of clipping lugs 139 overhang here the dosing chamber 200. The underneath thereof forms a lower surface 139'.

According to a possibility not shown, this lower surface 139' can have a shape that is complementary with the upper flank 51 of the outflow non-return valve 109. This makes it possible to cover this lower surface 139', therefore a part of the apex of the dosing chamber, with the membrane 50 of the outflow non-return valve 109. The dead volumes at the apex of the dosing chamber 200 are thus reduced.

Here the cylinder body 106 comprises as in the first exemplary embodiment:

- a cylinder body base 160,
- an annular protrusion 171 mounted at the bottom of the base of the cylinder body 160, in order to reinforce the tightness thereof at the end of travel with the drum 114,
- an upper sealing member 172 mounted at the top of the base of the cylinder body 160, in order to provide the tightness between the cylinder body 106 and the push-button 180.

This annular protrusion 171 and this upper sealing member 172 can be obtained with the same material and/or can be obtained together during the same injection operation. The latter can be carried out in the same way as in the first exemplary embodiment.

According to the second exemplary embodiment, as in this example, the upper sealing member 172 can include a central opening delimited by a flared surface 172', in particular tapered, with this opening widening from upstream to downstream. The second non-return valve 109 can be mounted in such a way that the edge 53 of its membrane 50 is bearing above and against this flared surface 172', in a position of rest and during the aspiration of the fluid from the passage orifice 120 of the connection member 110.

The connection member 110 is here mounted on the neck C of the container R, with its intermediate opening O in communication with on one side the inside of the container R and on the other side with the passage orifice 120.

According to the second exemplary embodiment, it is not necessary to add another non-return valve between the dosing outlet 173 and the dispensing orifice 181. The dispensing head 108 is here simpler.

This head 108 comprises a push-button 180, wherein is fixedly nested the base of cylinder body 160, in such a way as to actuate the cylinder body 106 downwards and to thus carry out the delivery of the fluid, while compressing the spring 104 downwards. When the pressure is released, the spring 104 returns the push-button 180 upwards and therefore the cylinder body 106, driving the aspiration of the fluid in the dosing chamber 200.

The dosing outlets 173 can as here be connected to the dispensing orifice 181 of the push-button 180 via a single duct 184, opening into an upper space 182, into which the dosing outlets 173 open directly when they are open.

A reducer 183 can be arranged in this upper space 182 in order to reduce dead volumes.

In these examples shown, the inflow non-return valve 5 of the first exemplary embodiment and the inflow non-return valve 105 and the outflow non-return valve 109 of the second exemplary embodiment are molded in a flexible material, in particular a TPE, with a Shore A hardness between 30 and 90. Moreover in these examples, the membrane 50 of these valves 5, 105, 109 has a thickness between 0.15 and 0.3 mm.

The invention claimed is:

1. Device for dispensing a liquid or pasty product to be dispensed comprising:

- a connection member intended to be installed at an open end of a container enclosing the product to be dispensed,
- a piston fixedly arranged with respect to the connection member,
- a cylinder body in which the piston is arranged in such a way as to define a dosing chamber between the piston and the cylinder body, the piston comprising at least one upstream opening forming a dosing inlet of the dosing chamber, and the dosing chamber comprising a dosing outlet, the cylinder body being slidable along the piston between a deployed position and a retracted position,
- an inflow non-return valve mounted on the piston and comprising an inflow membrane having a concave shape,
- the piston comprising a first part and a second part forming a sealing member fitted or over-molded around at least one portion of the first part, with this sealing member reinforcing the seal between the piston and the side wall or walls of the cylinder body, the piston and the inflow non-return valve forming separate parts and being arranged in such a way:

wherein, when the cylinder body is immobile or is displaced towards the retracted position, the inflow membrane is tightly clamped to the top of said joint and closes the dosing inlet, wherein the concave shape of the inflow membrane is elastically deformed and opens the dosing inlet when it is subjected to a negative pressure generated in the dosing chamber during the displacement of the cylinder body towards its deployed position; and wherein the inflow membrane has a shape of a cup of which an inflow cup edge delimits a periphery of the concave shape, with the concave shape facing the dosing inlet and the inflow cup edge being arranged around the dosing inlet, the inflow cup edge bearing under elastic stress against a top of the sealing member during said tight clamping, and the inflow cup edge moving away from a top of the piston during a negative pressure in the dosing chamber.

2. Device for dispensing according to claim 1, comprising a dispensing orifice in communication with the dosing outlet and an outflow non-return valve arranged between the dosing outlet and the dispensing orifice, in such a way as to clear a passage between the dosing outlet and the dispensing orifice under the exercise of an increase in pressure on the outflow non-return valve, the device for dispensing comprising only two valves, the outflow non-return valve and the inflow non-return valve.

3. Device for dispensing according to claim 1, wherein the sealing member comprises a central opening delimited by a flared surface and inside of which is arranged the dosing inlet, with this central opening widening from upstream to downstream, the inflow non-return valve being mounted in such a way that, during said tight clamping, the inflow cup edge is bearing above and against this flared surface.

4. Device for dispensing according to claim 1, wherein the inflow non-return valve comprises a central portion fixed to a top of the piston, the membrane being arranged around this central portion.

5. Device for dispensing according to claim 4, wherein the upper part of the first part of the piston comprises clipping lugs, between which is clipped the central portion, with the dosing inlet or inlets being arranged between these clipping lugs and the clipped part of the central portion.

6. Device for dispensing according to claim 5, wherein the clipping lugs comprise a convex upper portion (36*a*; 236*a*) of which a convexity is arranged facing a concavity of the concave shape.

7. Device for dispensing according to claim 1, wherein the piston is mounted in a tubular portion of the connection member.

8. Device for dispensing according to claim 1, wherein a stroke of the piston is less than a length of the sealing member.

9. Device for dispensing according to claim 1, wherein an apex of the dosing chamber forms a top wall inside of which the dosing outlet is formed and wherein, in the retracted position, at least one portion of a surface of the top wall is entirely covered, with this portion comprising the dosing outlet, with this covering being carried out either by a surface downstream of the inflow non-return valve, or by a surface downstream of the inflow non-return valve and one or several portions of the piston.

10. Device for dispensing according to claim 9, wherein the inflow non-return valve or the inflow non-return valve and the piston have faces facing the top wall, with these faces being of a shape that is complementary with the shape of at least the portion of the surface of the top wall which comprises the dosing outlet.

11. Device for dispensing according to claim 1, further comprising a dispensing orifice in communication with the dosing outlet and an outflow non-return valve arranged between the dosing outlet and the dispensing orifice, in such a way as to clear a passage between the dosing outlet and the dispensing orifice under exercise of an increase in pressure on the outflow non-return valve.

12. Device for dispensing according to claim 11, wherein the outflow non-return valve is mounted on the dosing outlet on the cylinder body and outside of the cylinder body.

13. Device for dispensing according to claim 12, wherein the outflow non-return valve comprises an outflow membrane having a concave shape able to be deformed elastically in such a way that:

when the outflow membrane is subjected to a negative pressure generated in the dosing chamber during the displacement of the cylinder body to its deployed position, the outflow membrane closes the dosing outlet by being tightly clamped to the top of the cylinder body, with the concave shape of the outflow membrane being deformed in such a way as to generate a return force of this membrane against the top of the cylinder body, in such a way as to maintain a tightly clamped stress, and when the cylinder body is immobile or is displaced towards the end-of-travel position, the concave shape of the outflow membrane is deformed elastically in such a way as to allow the fluid to pass.

14. Device for dispensing according to claim 11, further comprising a dispensing orifice in communication with the dosing outlet, wherein the outflow non-return valve is arranged in such a way as to close or open the dispensing orifice.

15. Device for dispensing according to claim 14, wherein the outflow non-return valve consecutively comprises:

an obturator of the dispensing orifice, an elastically deformable tank membrane connected to the obturator, a hermetic tank hermetically closed by the tank membrane, the outflow non-return valve being arranged in such a way that a face of the tank membrane outside the tank is in fluidic communication with a communication space that connects the dispensing orifice and the dosing outlet, in such a way that the tank membrane is stressed in deformation by the product during the actuating of the cylinder body towards said retracted position, in such a way as to drive the release of the obturator of the dispensing orifice, and the tank membrane is stressed in the opposite direction during a negative pressure in the dosing chamber, thus returning the obturator to a closed position of the dispensing orifice.

16. Device for dispensing according to claim 15, further comprising an added tube mounted in the passage orifice of the connection member intended to communicate with the opening of the container, in such a way that a lower end of the tube forms the inlet of the product in the device for dispensing.

17. Device for dispensing according to claim 16, wherein the tube has an inner section with a diameter that is at least 20% less than that of the passage orifice and is extended below the passage orifice.

18. Device for dispensing according to claim 1, wherein the piston comprises a lower peripheral lip in contact with the side wall or walls of the cylinder body.

19. Assembly for conditioning a liquid or pasty product to be dispensed, said assembly comprising:

a container intended for enclosing the product to be dispensed, and a device for dispensing according to claim 1 and installed at an open end of the container, in such a way that a passage orifice of the connection member communicates with an inside of the container.

* * * * *